US008594524B2

(12) United States Patent
Tsunoda

(10) Patent No.: US 8,594,524 B2
(45) Date of Patent: Nov. 26, 2013

(54) IMAGE FORMING APPARATUS

(75) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 310 days.

(21) Appl. No.: 12/962,760

(22) Filed: Dec. 8, 2010

(65) Prior Publication Data

US 2011/0142476 A1 Jun. 16, 2011

(30) Foreign Application Priority Data

Dec. 10, 2009 (JP) ..... 2009-280202

(51) Int. Cl.
*G03G 15/20* (2006.01)
*G03G 15/00* (2006.01)

(52) U.S. Cl.
CPC ..... *G03G 15/50* (2013.01); *G03G 15/20* (2013.01)
USPC ..... 399/70; 399/82; 399/328; 399/332

(58) Field of Classification Search
USPC ..... 399/67–70, 82, 85, 320, 328–332, 335, 399/337
See application file for complete search history.

(56) References Cited

U.S. PATENT DOCUMENTS

2009/0252520 A1* 10/2009 Segawa ..... 399/69

FOREIGN PATENT DOCUMENTS

| | | | |
|---|---|---|---|
| JP | 07-129026 | A | 5/1995 |
| JP | 2000-194211 | | 7/2000 |
| JP | 2005-345894 | A | 12/2005 |
| JP | 2006-267872 | A | 10/2006 |
| JP | 2007-264318 | A | 10/2007 |

* cited by examiner

*Primary Examiner* — Walter L Lindsay, Jr.
*Assistant Examiner* — Jessica L Eley
(74) *Attorney, Agent, or Firm* — Kubotera & Associates, LLC

(57) ABSTRACT

An image forming apparatus includes a fixing device; a mode selecting unit for selecting one of a normal mode and a power save mode; and a fixing control unit. The fixing device includes a rotational member, a pressing member disposed to press against the rotational member for sandwiching and pressing a print medium with the rotational member after a developer image is developed on the print medium, and a heating portion for heating the rotational member. In the normal mode, a normal printing operation is enabled. In the power save mode, the printing operation is partially terminated to conserve power consumption. The fixing control unit controls the rotational member to rotate for a specific amount when the mode selecting unit selects the power save mode.

16 Claims, 15 Drawing Sheets

IMAGE FORMING APPARATUS

BACKGROUND OF THE INVENTION AND RELATED ART STATEMENT

The present invention relates to an image forming apparatus such as a printer, a facsimile, a copier, and an MFP (a multi function peripheral or product) using an electro-photography type. In particular, the present invention relates to a fixing device of the image forming apparatus.

In a conventional image forming apparatus such as a printer, a facsimile, a copier, and an MFP (a multi function peripheral or product) using an electro-photography type, a charging roller uniformly charges a surface of a photosensitive drum. Then, an exposure device such as an LED (Light Emitting Diode) exposes the surface of the photosensitive drum to form a static latent image thereon. In the next step, a thin layer of toner formed on a developing roller is attached to the static latent image to form a toner image on the photosensitive drum. Afterward, the toner image formed on the photosensitive drum is transferred to a print medium supplied from a sheet supply device.

In the next step, after the toner image is transferred to the print medium, the print medium is transported to a fixing device. In the fixing device, heat and pressure are applied to the print medium, so that the toner image is fixed to the print medium, thereby forming an image on the print medium.

In the conventional image forming apparatus, the fixing device may be of a film heating type, in which a film is used as a rotational member. In the fixing device of the film heating type, the print medium is closely contacted with a heater through a heat resistant film. Further, a pressing roller is disposed as a pressing member to press against the heat resistant film. When the pressing roller rotates, the heater and the heat resistant film move relatively, thereby transporting the print medium. During the process, heat of the heater is conducted to toner and the print medium through the heat resistant film. When the fixing device is the film heating type, it is possible to use the heater (a heating member) with a low heat capacity at a high heating speed, and to use the heat resistant film with a small thickness. Accordingly, it is possible to increase a temperature of the components to a specific level in a short period of time. As a result, it is possible to reduce power consumption and a wet time (quick start) (Refer to Patent Reference).

Patent Reference: Japanese Patent Publication No. 2000-194211

In the conventional fixing device described above, the pressing member is pressed against the rotational member to form a nip portion therebetween for performing the fixing operation. When the pressing member is pressed against the rotational member at a high temperature for a prolonged period of time, the rotational member and an elastic layer of the pressing member tend to generate creep. In this case, when the printing operation is performed next time, a gloss variation tends to occur in an image.

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to a first aspect of the present invention, an image forming apparatus includes a fixing device; a mode selecting unit for selecting one of a normal mode and a power save mode; and a fixing control unit. The fixing device includes a rotational member, a pressing member disposed to press against the rotational member for sandwiching and pressing a print medium with the rotational member after a developer image is developed on the print medium, and a heating portion for heating the rotational member. In the normal mode, a normal printing operation is enabled. In the power save mode, the printing operation is partially terminated to conserve power consumption. The fixing control unit controls the rotational member to rotate for a specific amount when the mode selecting unit selects the power save mode.

According to a second aspect of the present invention, in the image forming apparatus in the first aspect, the fixing control unit controls the rotational member to rotate for a specific amount when a temperature of the rotational member or the pressing member becomes below a specific level in the power save mode.

According to a third aspect of the present invention, in the image forming apparatus in the first aspect, the mode selecting unit is arranged to select the power save mode including a first power save mode and a second power save mode. In the first power save mode, the printing operation is partially terminated to conserve a specific amount of the power consumption. In the second power save mode, the power consumption is conserved to an extent further than that in the first power save mode. The fixing control unit controls the rotational member to rotate for the specific amount when the mode selecting unit switches from the first power save mode to the second power save mode.

As described above, in the first aspect of the present invention, the fixing control unit controls the rotational member to rotate for the specific amount when the mode selecting unit selects the power save mode. Accordingly, it is possible to prevent the rotational member from generating creep. As a result, it is possible to prevent an image gloss variation (a nip mark).

In the second aspect of the present invention, the fixing control unit controls the rotational member to rotate for the specific amount when the temperature of the rotational member or the pressing member becomes below the specific level in the power save mode. Accordingly, it is possible to further effectively prevent the rotational member from generating creep.

In the second aspect of the present invention, the mode selecting unit is arranged to select the power save mode including the first power save mode and the second power save mode. In the first power save mode, the printing operation is partially terminated to conserve a specific amount of the power consumption. In the second power save mode, the power consumption is conserved to an extent further than that in the first power save mode. The fixing control unit controls the rotational member to rotate for the specific amount when the mode selecting unit switches from the first power save mode to the second power save mode. Accordingly, even when the mode selecting unit switches from the first power save mode to the second power save mode, and the fixing device remains in a low temperature for a long period of time, it is possible to prevent creep generated in a low temperature.

Figure 1A:
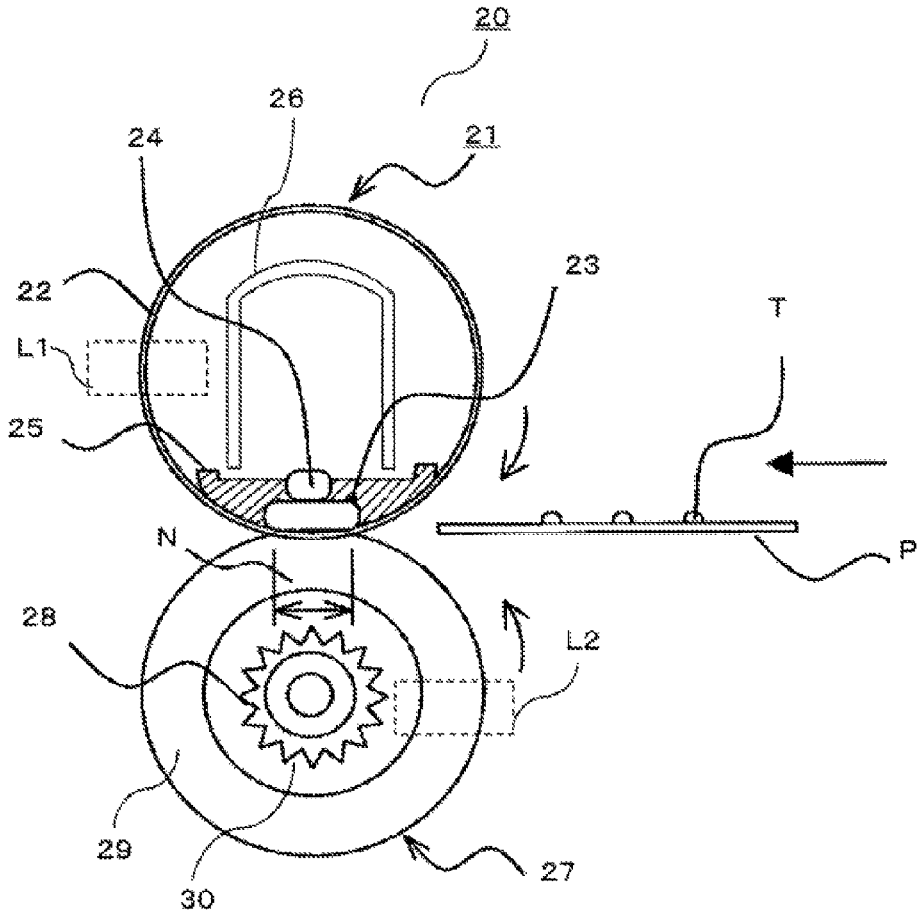
FIGS. 1(*a*) to 1(*c*) are schematic sectional views showing a fixing device of an image forming apparatus according to a first embodiment of the present invention, wherein FIG. 1(*a*) is a schematic sectional view showing the fixing device, FIG.
Figure 1B:
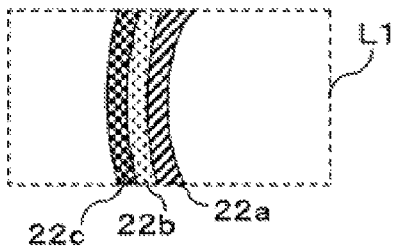
Figure 1C:
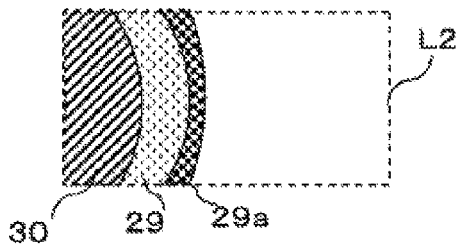
Figure 2:
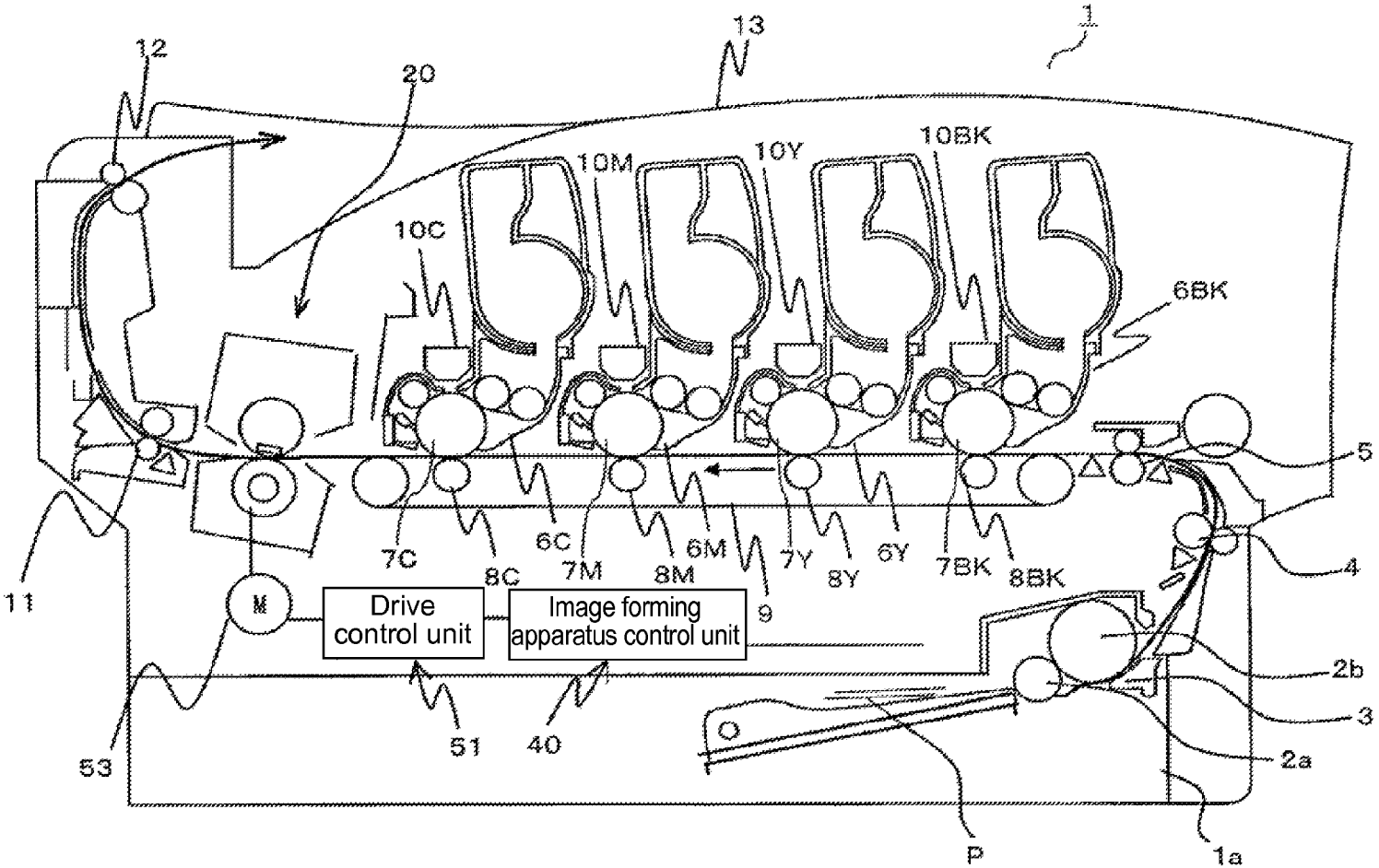
Figure 3:
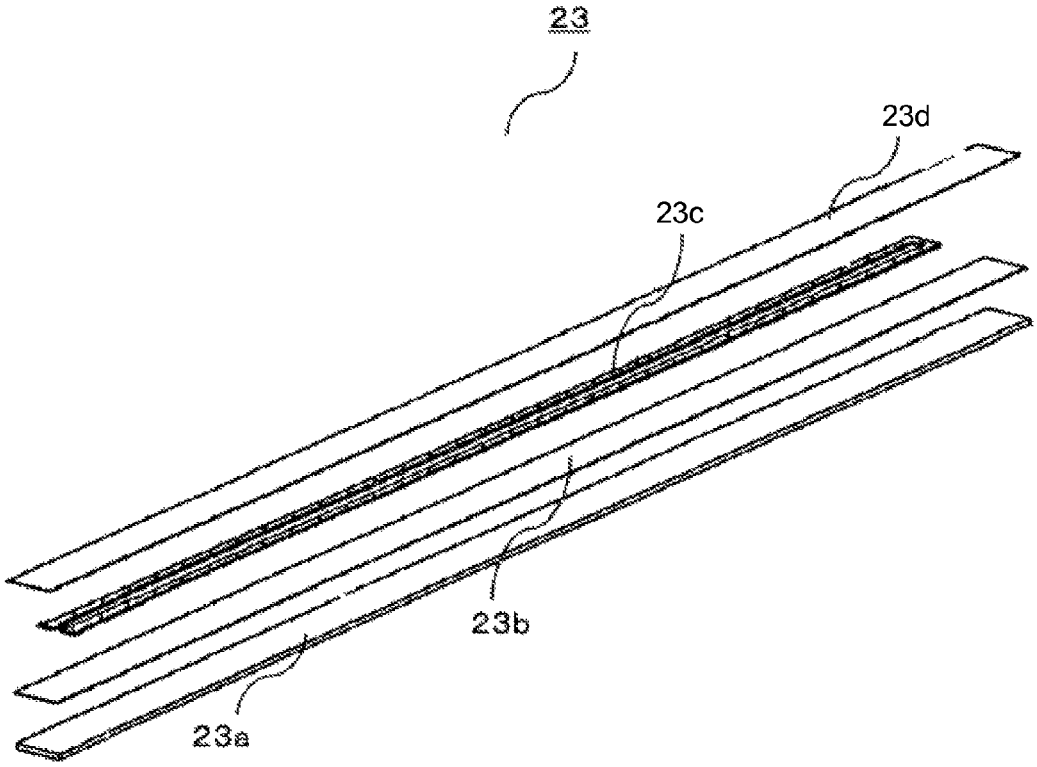
Figure 4:
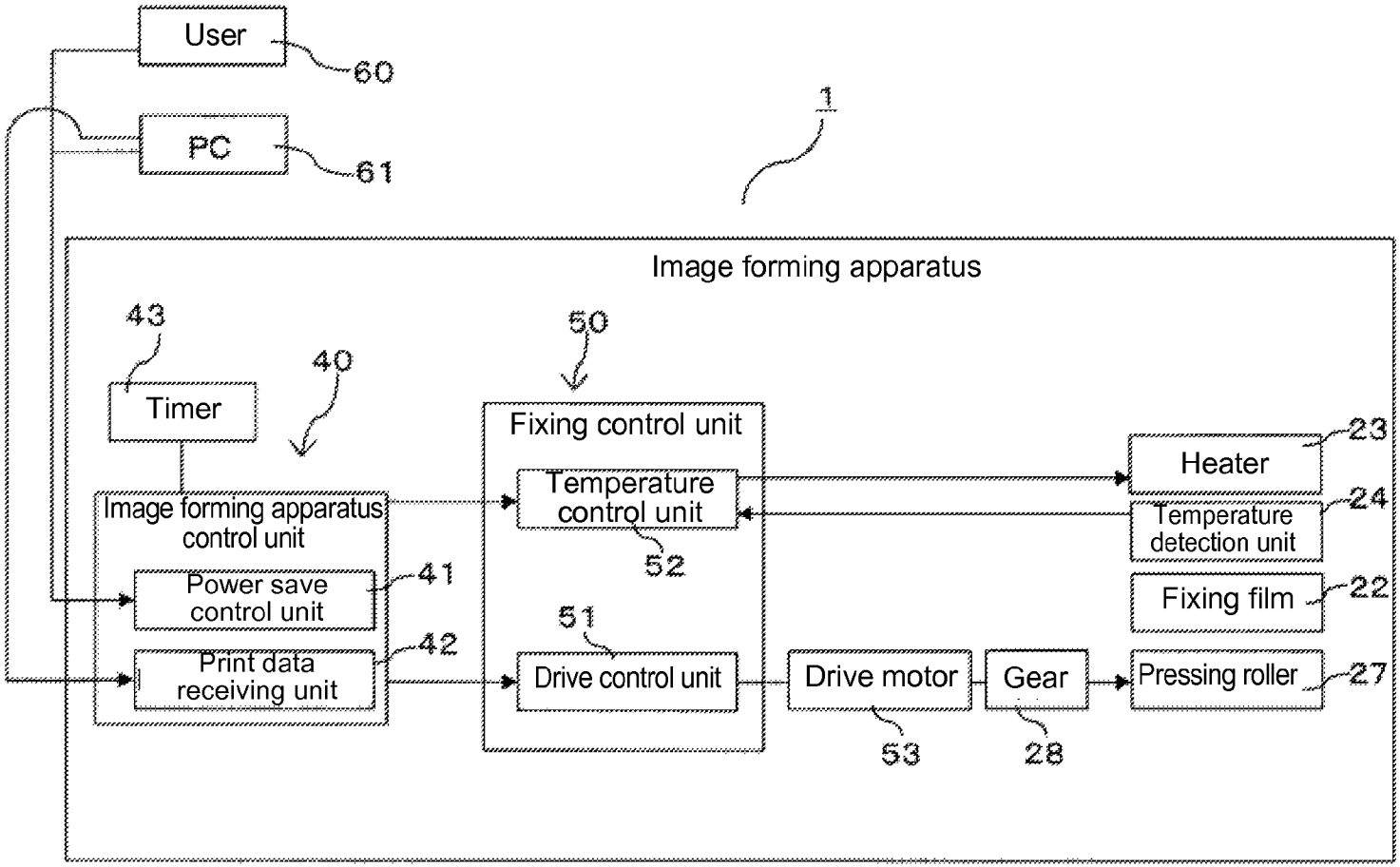
Figure 5A:
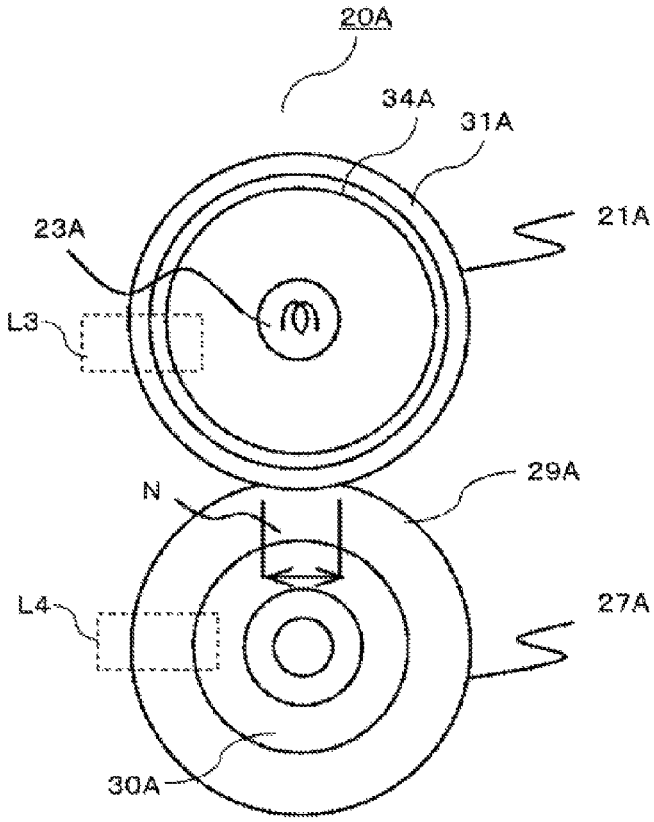
Figure 5B:
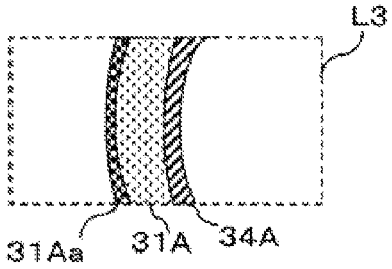
Figure 5C:
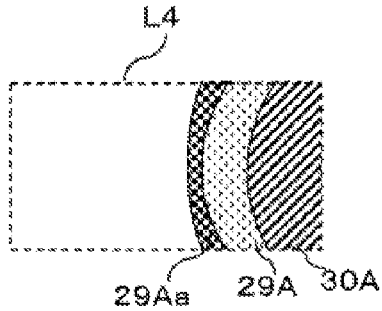
Figure 6A:
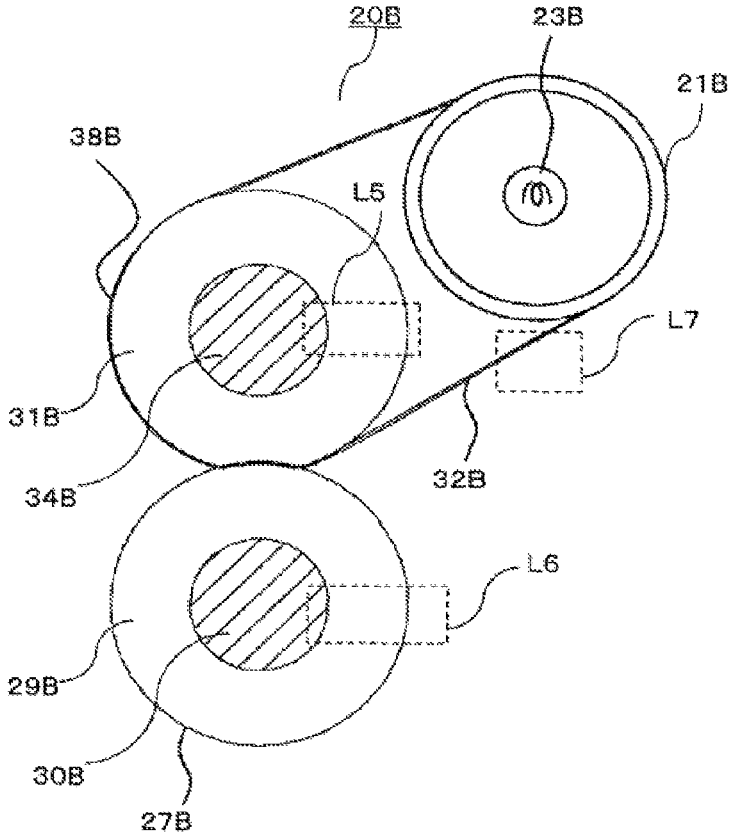
Figures 6B, 6C, 6D:
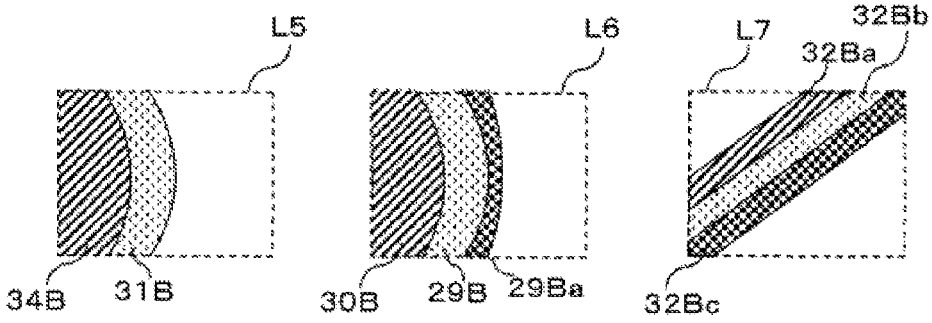
Figure 7A:
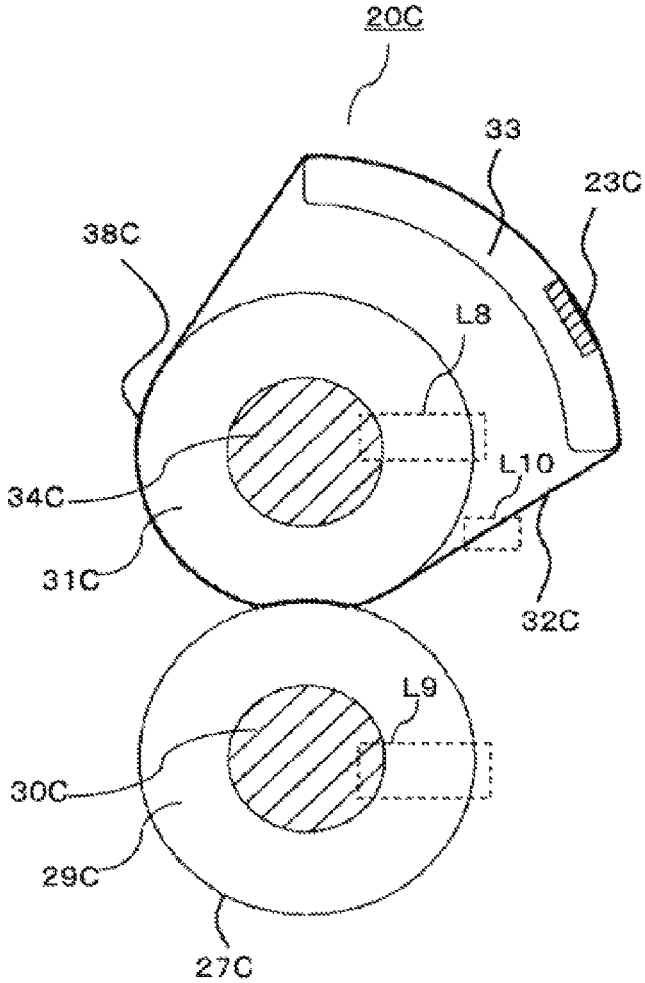
Figure 7B:
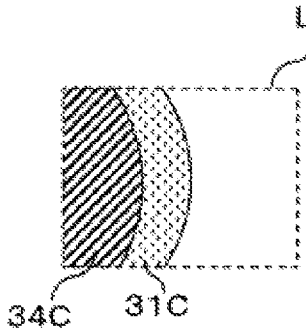
Figure 7C:
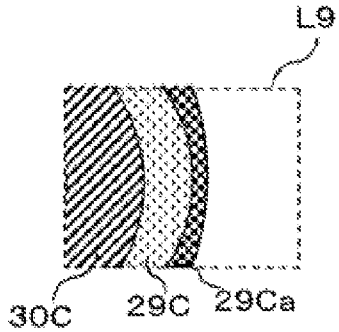
Figure 7D:
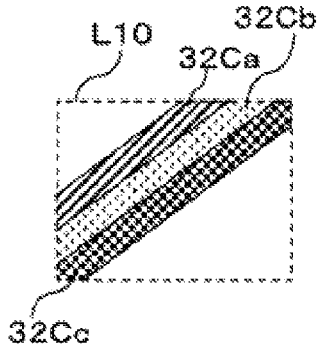
Figure 8A:
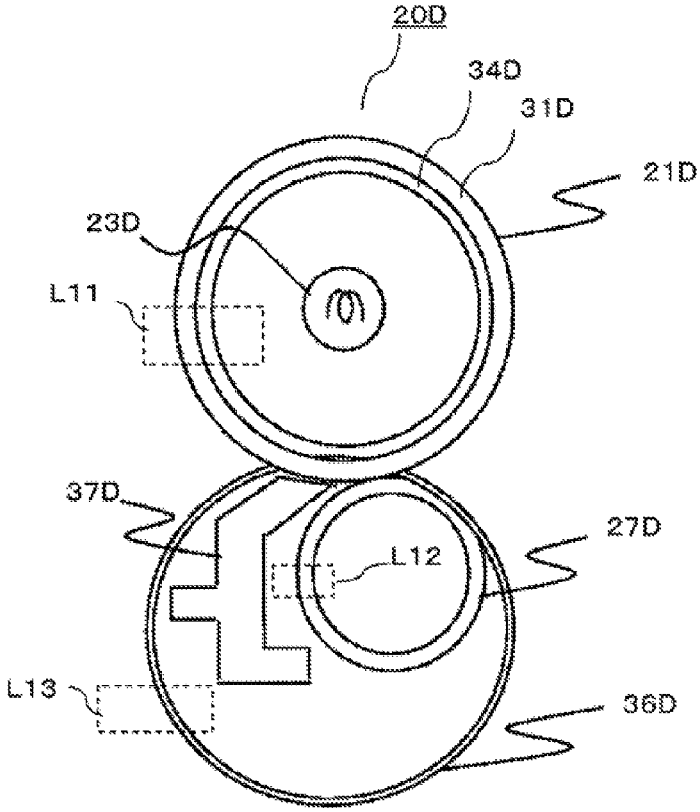
Figure 8B:
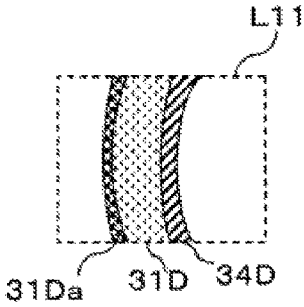
Figure 8C:
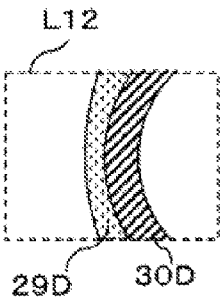
Figure 8D:
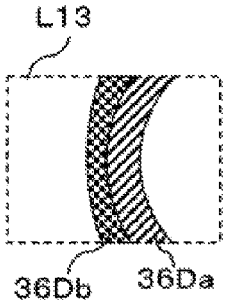
Figure 9:
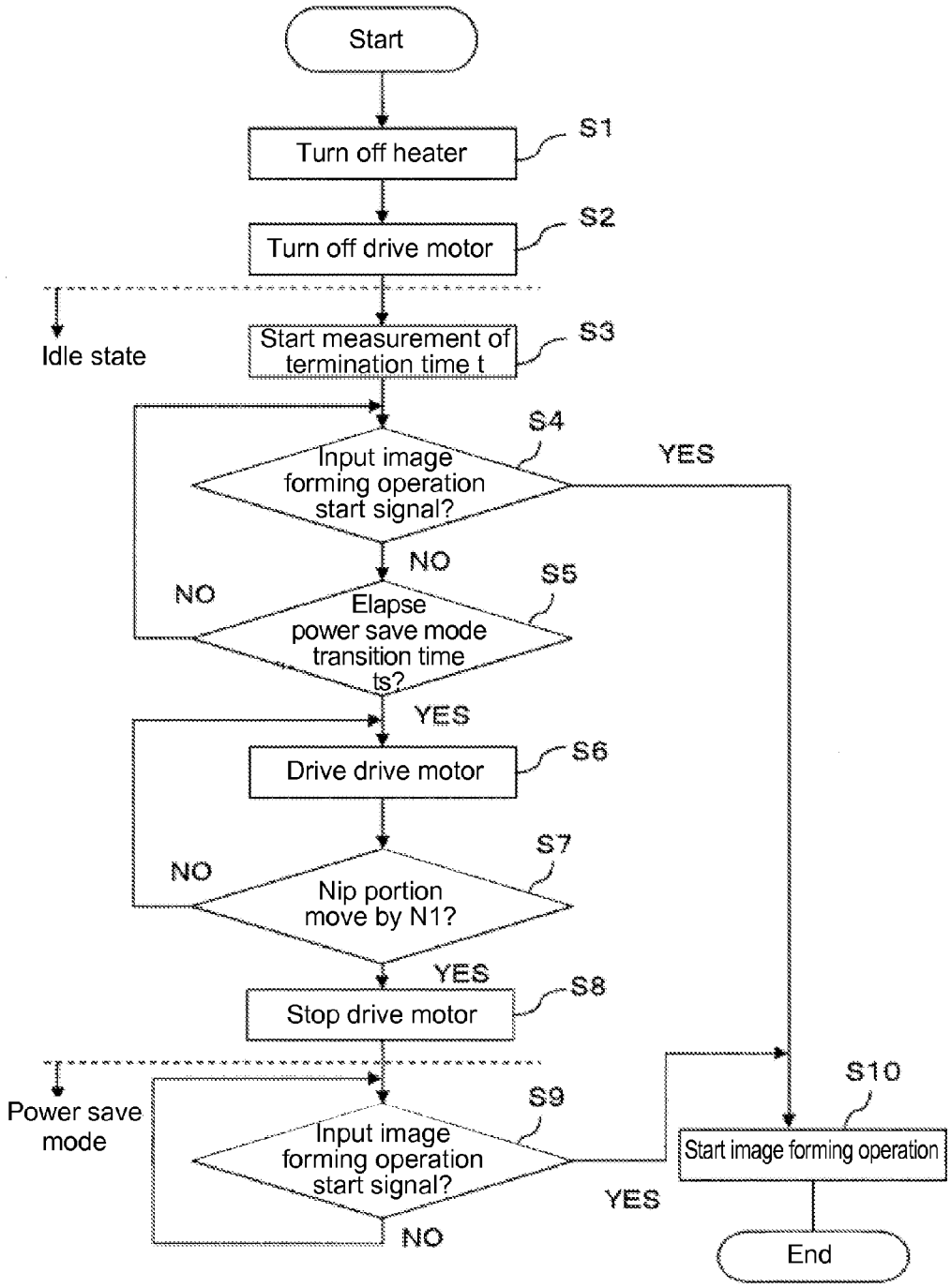
Figure 10:
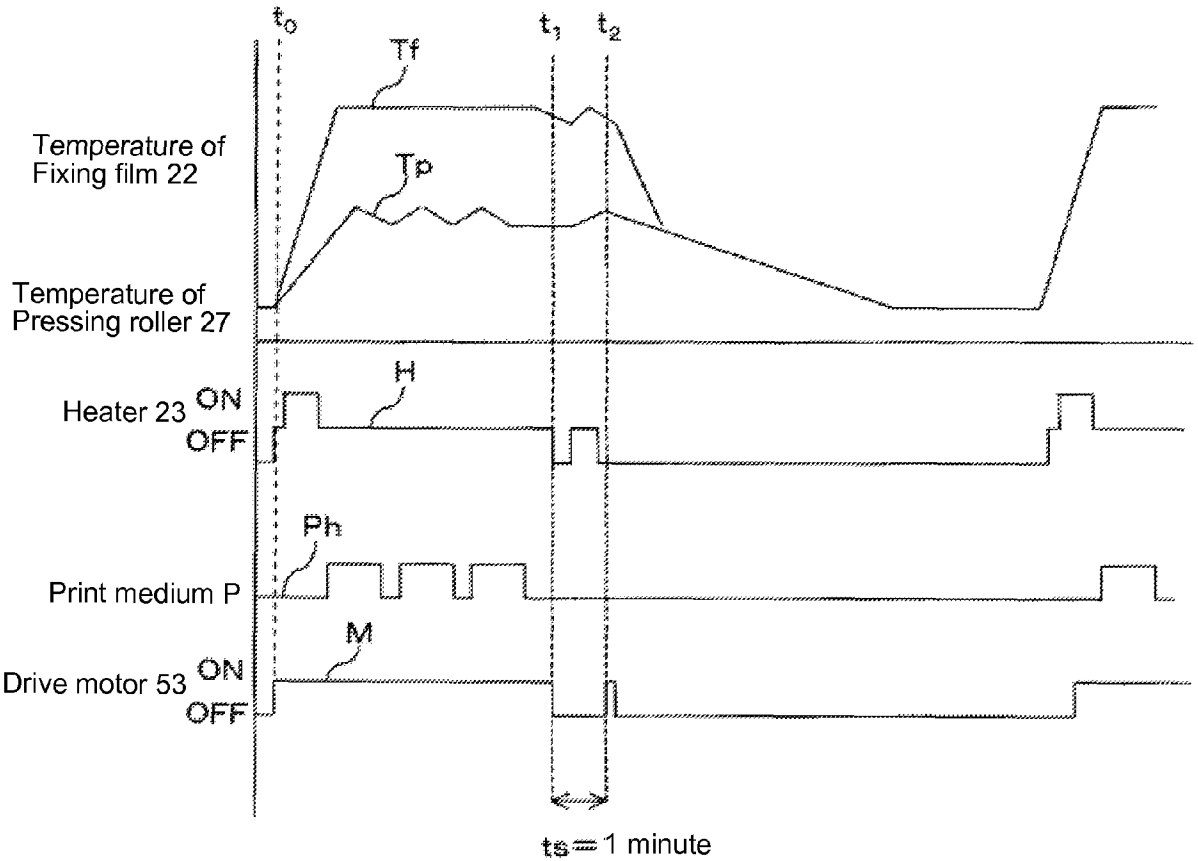
Figure 11:
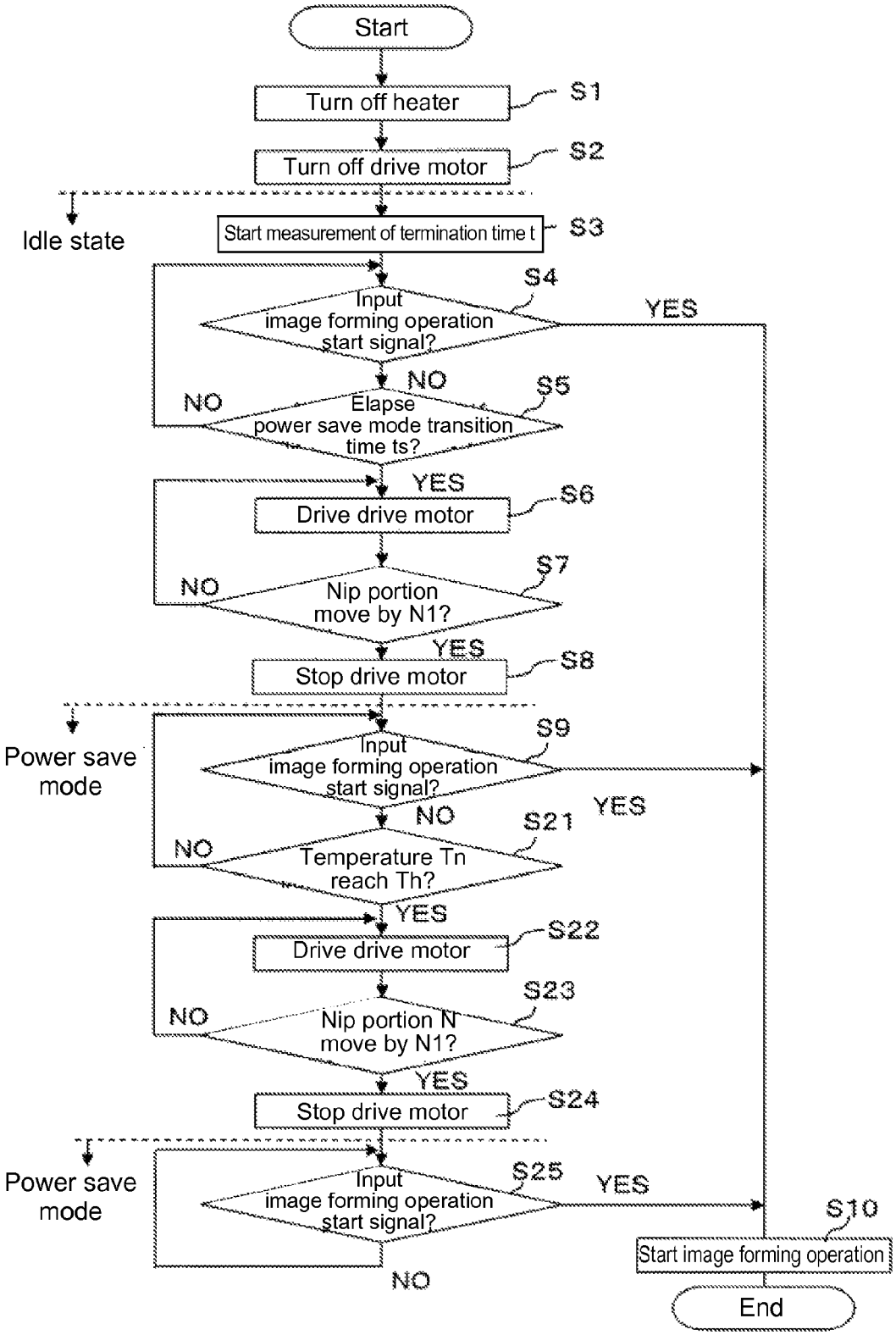
Figure 12:
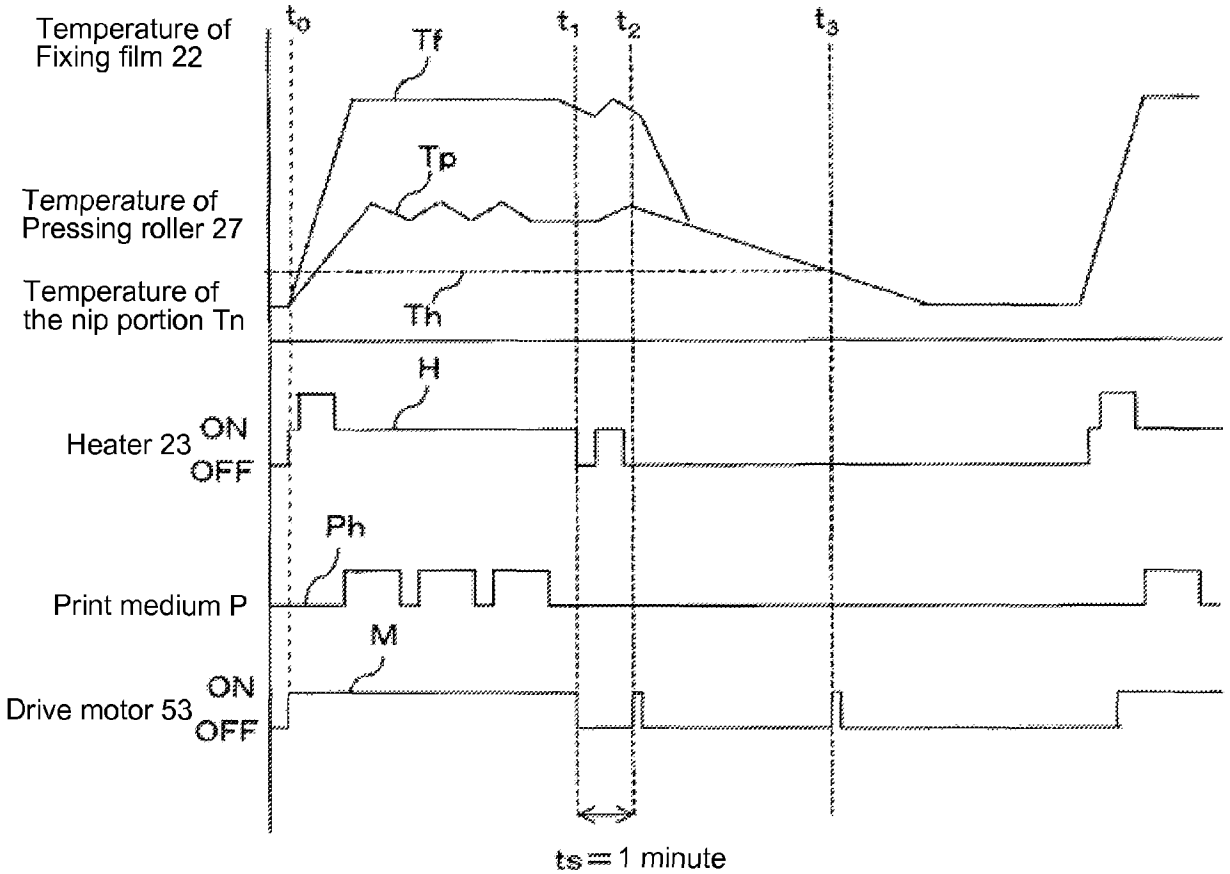
Figure 13:
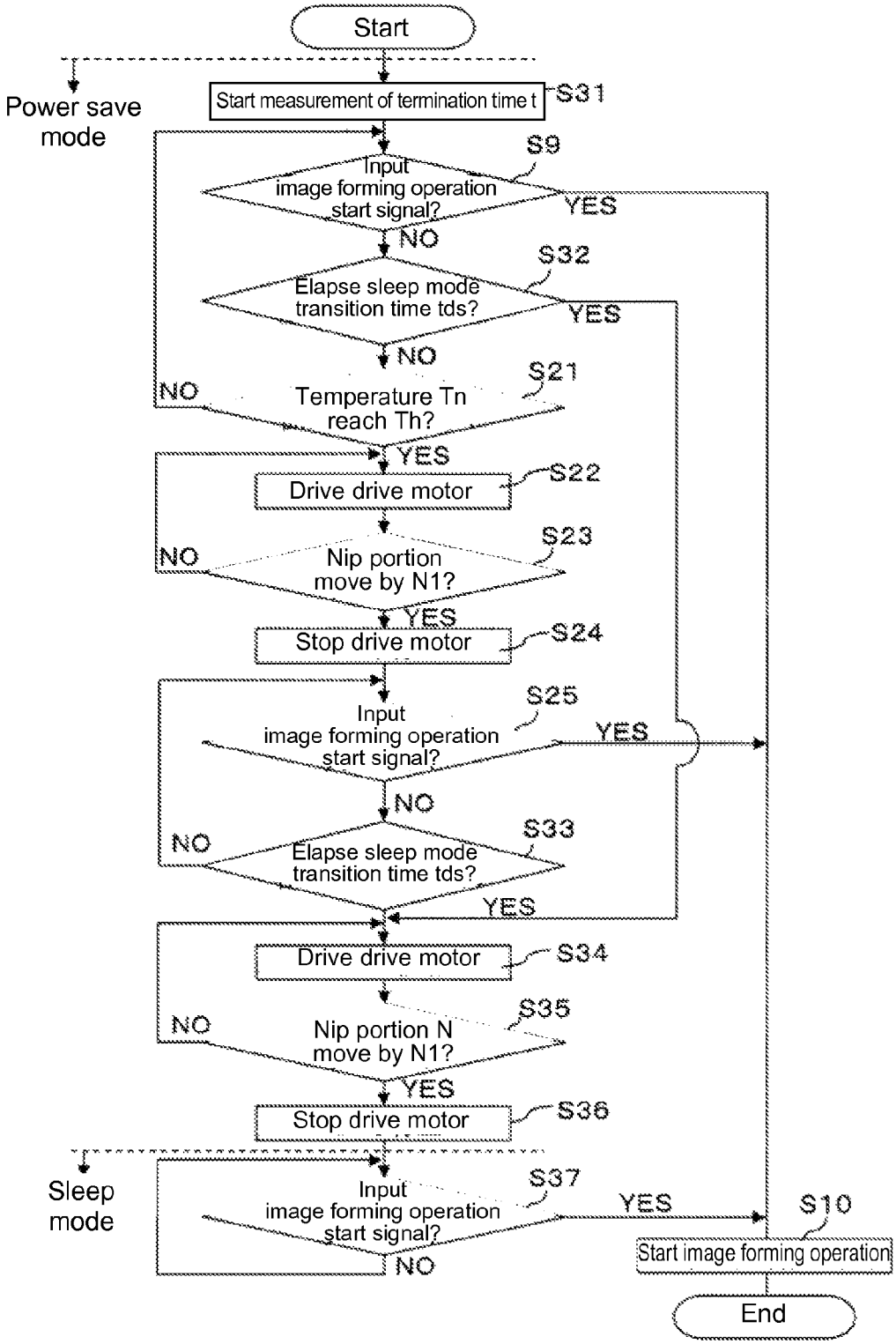
Figure 14:
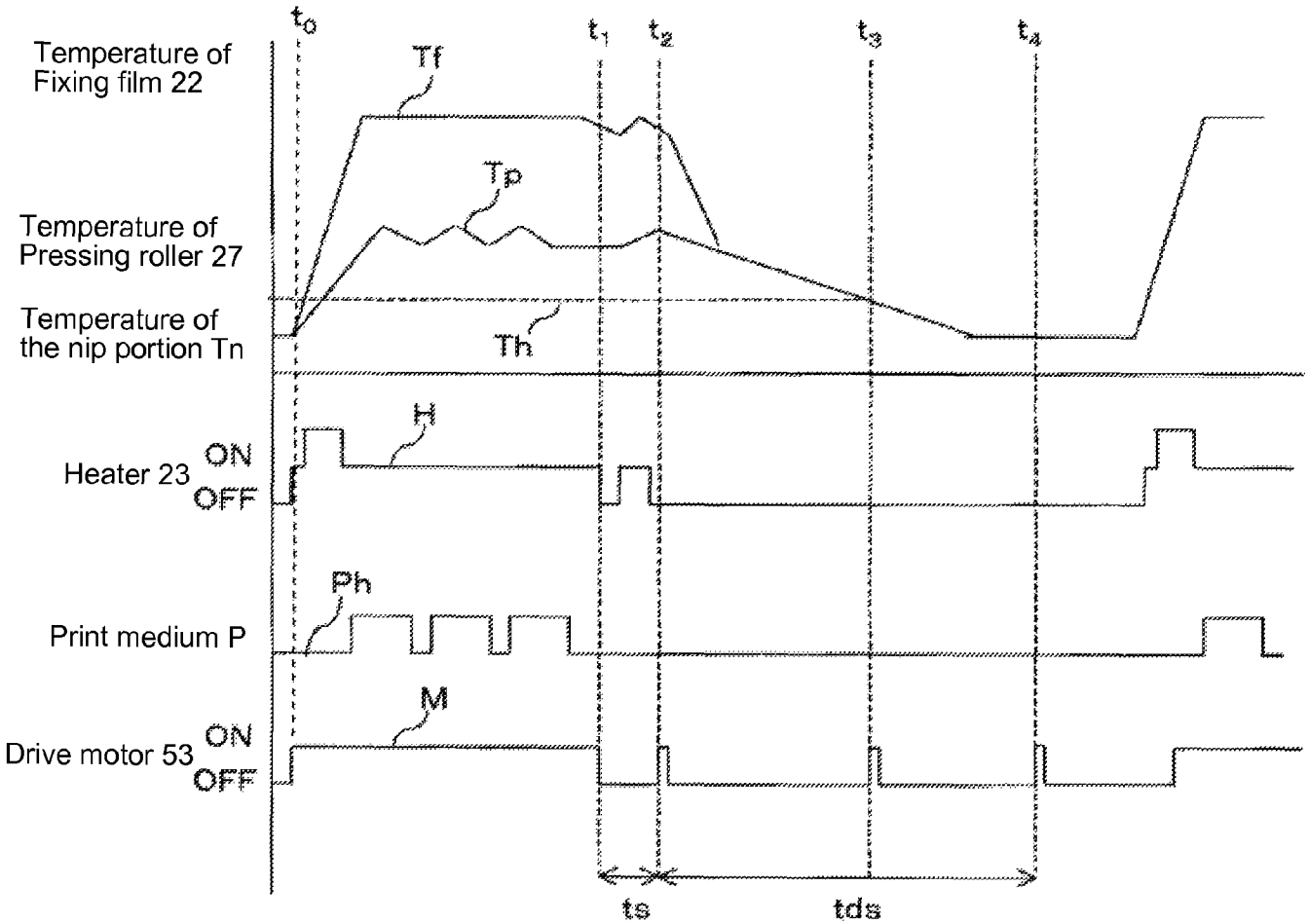
Figure 15:
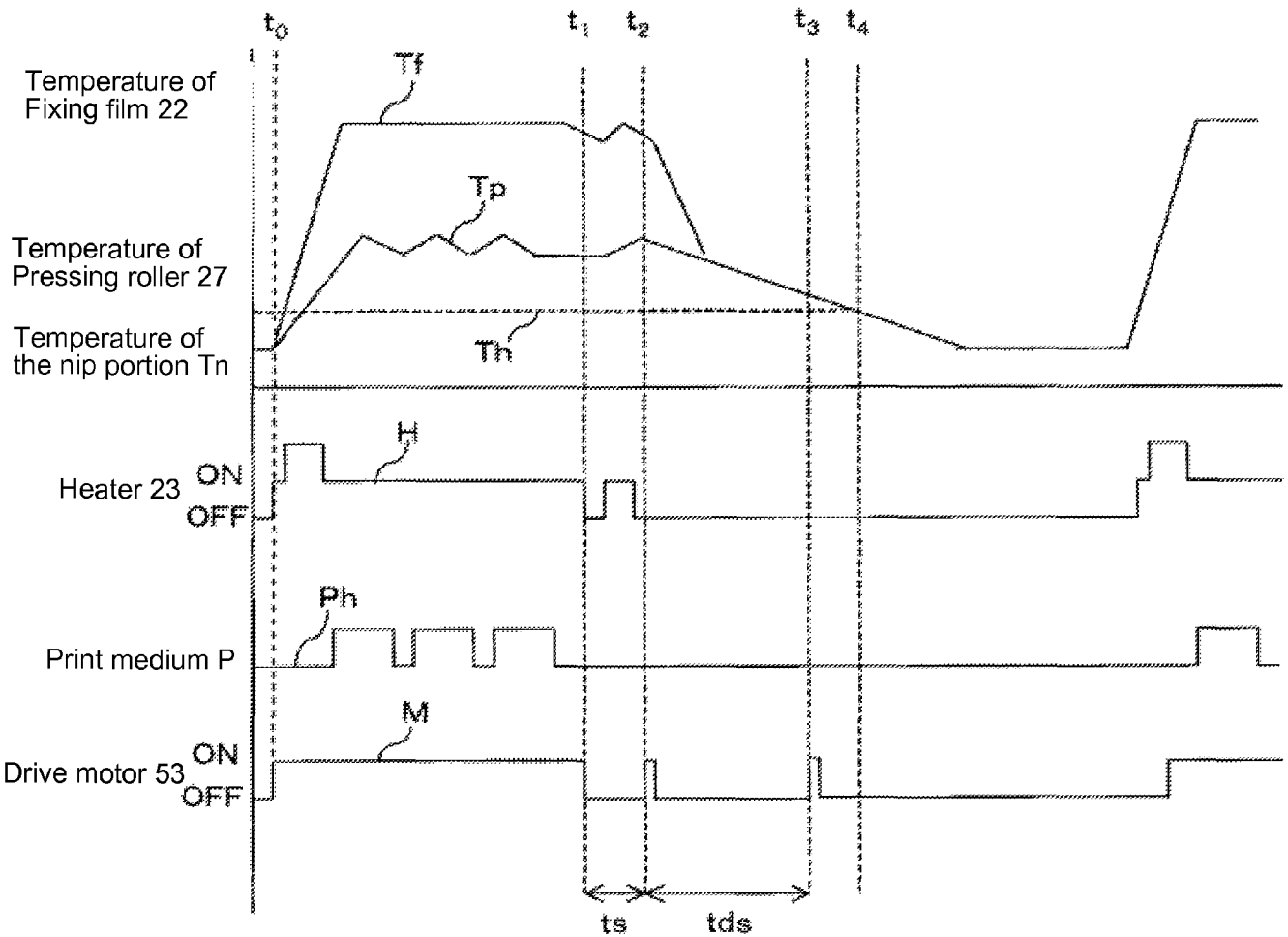

1(*b*) is an enlarged view of a portion L1 in FIG. 1(*a*), and FIG. 1(*c*) is an enlarged view of a portion L2 in FIG. 1(*a*);

FIG. 2 is a schematic sectional view showing a configuration of the image forming apparatus according to the first embodiment of the present invention;

FIG. 3 is a schematic perspective view showing a ceramic heater of the fixing device according to the first embodiment of the present invention;

FIG. 4 is a block diagram showing a control system of the image forming apparatus according to the first embodiment of the present invention;

FIGS. 5(*a*) to 5(*c*) are schematic sectional views showing a modified example No. 1 of the fixing device of the image forming apparatus according to the first embodiment of the present invention, wherein FIG. 5(*a*) is a schematic sectional view showing the modified example No. 1 of the fixing device, FIG. 5(*b*) is an enlarged view of a portion L3 in FIG. 5(*a*), and FIG. 5(*c*) is an enlarged view of a portion L4 in FIG. 5(*a*);

FIGS. 6(*a*) to 6(*d*) are schematic sectional views showing a modified example No. 2 of the fixing device of the image forming apparatus according to the first embodiment of the present invention, wherein FIG. 6(*a*) is a schematic sectional view showing the modified example No. 2 of the fixing device, FIG. 6(*b*) is an enlarged view of a portion L5 in FIG. 6(*a*), FIG. 6(*c*) is an enlarged view of a portion L6 in FIG. 6(*a*), and FIG. 6(*d*) is an enlarged view of a portion L7 in FIG. 6(*a*);

FIGS. 7(*a*) to 7(*d*) are schematic sectional views showing a modified example No. 3 of the fixing device of the image forming apparatus according to the first embodiment of the present invention, wherein FIG. 7(*a*) is a schematic sectional view showing the modified example No. 3 of the fixing device, FIG. 7(*b*) is an enlarged view of a portion L8 in FIG. 7(*a*), FIG. 7(*c*) is an enlarged view of a portion L9 in FIG. 7(*a*), and FIG. 7(*d*) is an enlarged view of a portion L10 in FIG. 7(*a*);

FIGS. 8(*a*) to 8(*d*) are schematic sectional views showing a modified example No. 4 of the fixing device of the image forming apparatus according to the first embodiment of the present invention, wherein FIG. 8(*a*) is a schematic sectional view showing the modified example No. 4 of the fixing device, FIG. 8(*b*) is an enlarged view of a portion L11 in FIG. 8(*a*), FIG. 8(*c*) is an enlarged view of a portion L12 in FIG. 8(*a*), and FIG. 8(*d*) is an enlarged view of a portion L13 in FIG. 8(*a*);

FIG. 9 is a flow chart showing an operation of the image forming apparatus according to the first embodiment of the present invention;

FIG. 10 is a time chart showing the operation of the image forming apparatus according to the first embodiment of the present invention;

FIG. 11 is a flow chart showing an operation of an image forming apparatus according to a second embodiment of the present invention;

FIG. 12 is a time chart showing the operation of the image forming apparatus according to the second embodiment of the present invention;

FIG. 13 is a flow chart showing an operation of an image forming apparatus according to a third embodiment of the present invention;

FIG. 14 is a time chart No. 1 showing the operation of the image forming apparatus according to the third embodiment of the present invention; and FIG. 15 is a time chart No. 2 showing the operation of the image forming apparatus according to the third embodiment of the present invention.

DETAILED DESCRIPTION OF PREFERRED EMBODIMENTS

Hereunder, embodiments of the present invention will be explained with reference to the accompanying drawings. In the following description, the drawings are referred for explaining the embodiments, and do not limit the scope of the present invention.

First Embodiment

A first embodiment of the present invention will be explained. FIG. 2 is a schematic sectional view showing a configuration of an image forming apparatus 1 according to the first embodiment of the present invention. The image forming apparatus 1 is, for example, a printer.

As shown in FIG. 2, the image forming apparatus 1 includes a sheet supply cassette 1*a* disposed at a lower portion thereof for retaining a print medium P. A sheet supply unit is disposed adjacent to a front end portion of the sheet supply cassette 1*a*. The sheet supply unit includes sheet supply rollers 2*a* and 2*b*, and a separation member 3 for separating and transporting the print medium P one by one. A transportation roller 4 and a register roller 5 are disposed above the sheet supply unit.

In the embodiment, the image forming apparatus 1 further includes image forming units 6 (6Bk, 6Y, 6M, and 6C) for forming developer images T (toner images) in colors of black, yellow, magenta, and cyan on the print medium P. Each of the image forming units 6 (6Bk, 6Y, 6M, and 6C) includes a photosensitive drum 7 (7Bk, 7Y, 7M, or 7C), a charging unit (not shown), a developing device (not shown), and a photosensitive member cleaning unit. Each of the image forming units 6 is formed in an integrated unit, and is detachably attached to the image forming apparatus 1. An upper cover 13 is disposed at an upper portion of the image forming apparatus 1 to be freely opened and closed.

In the embodiment, the image forming apparatus 1 further includes exposure devices 10 (10Bk, 10Y, 10M, and 10C) arranged to face the photosensitive drums 7 (7Bk, 7Y, 7M, and 7C) and supported with the upper cover 13. Each of the exposure devices 10 (10Bk, 10Y, 10M, and 10C) is provided for forming a static latent image on a surface of each of the photosensitive drums 7 (7Bk, 7Y, 7M, and 7C). Further, transfer rollers 8 (8Bk, 8Y, 8M, and 8C) are arranged to face the photosensitive drums 7 (7Bk, 7Y, 7M, and 7C) through a transportation belt 9.

In the embodiment, the image forming apparatus 1 further includes a fixing device 20 as a fixing portion disposed on a downstream side of the transportation belt 9. After the print medium P is discharged from the fixing device 20, a discharge roller 11 transports the print medium P, and a discharge transportation roller 12 discharges the print medium P on the upper cover 13. A drive motor 53 drives the fixing device 20 to transport the print medium P. A drive control unit 51 controls the drive motor 53, and an image forming apparatus control unit 40 controls the drive control unit 51. Further, the image forming apparatus control unit 40 controls an entire operation of the image forming apparatus 1.

A configuration of the fixing device 20 will be explained next. FIGS. 1(*a*) to 1(*c*) are schematic sectional views showing the fixing device 20 of an image forming apparatus 1 according to a first embodiment of the present invention. More specifically, FIG. 1(*a*) is a schematic sectional view showing the fixing device 20, FIG. 1(*b*) is an enlarged view of a portion L1 in FIG. 1(*a*), and FIG. 1(*c*) is an enlarged view of a portion L2 in FIG. 1(*a*). FIG. 3 is a schematic perspective view showing a ceramic heater 23 of the fixing device 20 according to the first embodiment of the present invention.

As shown in FIG. 1(*a*), as an example in the first embodiment of the present invention, the fixing device 20 as the fixing portion is a film heating type, and includes a rotational member (for example, a fixing film 22) arranged to be rotatable and a pressing member (for example, a pressing roller 27) arranged to be rotatable. The fixing film 22 is arranged to press against the pressing roller 27 for forming a contact portion or a nip portion N.

In the embodiment, the fixing device 20 includes a fixing unit 21. The fixing unit 21 is formed of the fixing film 22, the heater 23 as a heating member, a fixing film guide 25 as a heater holder, a pressing metal plate 26 in a reversed L character shape, and a circular flange member (not shown) as a fixing film regulating member. The fixing film 22 is arranged to be rotatable along the fixing film guide 25. The fixing film guide 25 is integrally formed of a heat resistant resin such as a liquid crystal polymer, a phenolic resin, and the like. Further, the fixing film guide 25 holds and supports the heater 23 on a lower center portion thereof along a longitudinal direction thereof with a heat resistant adhesive and the like.

As shown in FIG. 3, the heater 23 is the ceramic heater formed of a base member 23*a* made of stainless steel, a ceramic, and the like. In the heater 23, an electric insulation layer 23*b* made of glass and the like is disposed on the base member 23*a*, and a resistor heating member 23*c* made of powders of a nickel-chrome alloy or a silver-palladium alloy is coated on the electric insulation layer 23*b*. Further, a protective layer 23*d* made of glass, a fluorine type resin (PEA, PTFE, FEP), and the like is disposed on the resistor heating member 23*c*.

In the embodiment, the pressing roller 27 includes a core metal 30 formed in a pipe made of steel or aluminum, a gear 28 disposed on the core metal 30, and an elastic layer 29 made of a silicone rubber. The pressing roller 27 is supported to be rotatable through a bearing portion. When the pressing roller 27 rotates in a state of being pressed against the fixing film 22, the fixing film 22 follows the rotation of the pressing roller 27 to rotate.

In the embodiment, more specifically, the pressing roller 27 has a diameter of 20 mm, and the core metal 30 is an aluminum shaft having a diameter of 6 mm. The fixing film 22 has a diameter of 24 mm, and the heater 23 has a thickness of 1 mm and a width of 6 mm. Further, the heater 23 and the pressing roller 27 are arranged to form the nip portion N having a length of 240 mm in a longitudinal direction thereof. It is configured such that the nip portion N has a sectional width of 5 mm when a total pressing force is 15 kgf.

As described above, FIG. 1(*b*) is the enlarged view of the portion L1 in FIG. 1(*a*). As shown in FIG. 1(*b*), the fixing film 22 includes a base member 22*a* formed of a polyimide resin or stainless steel, an elastic layer 22*b* formed of a silicone rubber, and a releasing layer 22*c* formed of a member coated with fluorine or a fluorine resin tube.

As described above, FIG. 1(*c*) is the enlarged view of the portion L2 in FIG. 1(*a*). As shown in FIG. 1(*c*), the pressing roller 27 includes the core metal 30 formed in a pipe made of steel or aluminum, the elastic layer 29 formed of a silicone rubber, and a releasing layer 29*a* formed of a member coated with fluorine or a fluorine resin tube.

A control system of the image forming apparatus 1 will be explained next. FIG. 4 is a block diagram showing the control system of the image forming apparatus 1 according to the first embodiment of the present invention.

As shown in FIG. 4, the image forming apparatus 1 includes the image forming apparatus control unit 40 for controlling an entire operation of the image forming apparatus 1. The image forming apparatus control unit 40 includes a mode selection unit (for example, a power save control unit 41) and a print data receiving unit 42. The power save control unit 41 is provided for selecting between a normal mode for performing a printing operation and a power save mode, in which the printing operation is partially terminated to conserve power consumption. The print data receiving unit 42 is provided for receiving print data from a host device such as a personal computer 61 and the like.

In the embodiment, the image forming apparatus control unit 40 is connected to a timer 43 having a time measuring function and the fixing control unit 50 for controlling the fixing device 20. The fixing control unit 50 includes a temperature control unit 52 for controlling a temperature of the heater 23, and the drive control unit 51 for driving the drive motor 53 to rotate the pressing roller 27.

In the embodiment, the temperature control unit 52 is connected to the heater 23 for heating the fixing film 22 of the fixing unit 21 and a temperature detection unit 24 for detecting a surface temperature of the heater 23. When the temperature detection unit 24 detects the surface temperature of the heater 23, the surface temperature is input to the temperature control unit 52, so that the temperature control unit 52 maintains the temperature at a predetermined specific level. The drive control unit 51 is connected to the drive motor 53, and the drive motor 53 is connected to the pressing roller 27 through the gear 28.

In the embodiment, when the gear 28 attached to an end portion of the core metal 30 receives a drive force from the drive motor 53, the pressing roller 27 rotates. The drive control unit 51 is provided for controlling the drive motor 53. According to information from a user 60 and the personal computer 61, the image forming apparatus control unit 40 instructs the drive control unit 51 and the temperature control unit 52 to start a control operation of the fixing device 20.

A modified example No. 1 of the fixing device 20 will be explained next. FIGS. 5(*a*) to 5(*c*) are schematic sectional views showing the modified example No. 1 as a fixing device 20A of the image forming apparatus 1 according to the first embodiment of the present invention. More specifically, FIG. 5(*a*) is a schematic sectional view showing the modified example No. 1 as the fixing device 20A, FIG. 5(*b*) is an enlarged view of a portion L3 in FIG. 5(*a*), and FIG. 5(*c*) is an enlarged view of a portion L4 in FIG. 5(*a*).

As shown in FIG. 5(*a*), the fixing device 20A is a two-roller type. More specifically, the fixing device 20A includes a rotational member (for example, a heating roller 21A), an elastic layer 31A constituting a part of the heating roller 21A, a halogen heater (for example, a heater 23A) as a heating member, a pressing member (for example, a pressing roller 27A), and an elastic layer 29A constituting a part of the pressing roller 27A.

As described above, FIG. 5(*b*) is the enlarged view of the portion L3 in FIG. 5(*a*). As shown in FIG. 5(*b*), the heating roller 21A includes a core metal 34A formed in a pipe made of steel or aluminum, the elastic layer 31A formed of a silicone rubber, and a releasing layer 31Aa formed of a member coated with fluorine or a fluorine resin tube.

As described above, FIG. 5(*c*) is the enlarged view of the portion L4 in FIG. 5(*a*). As shown in FIG. 5(*c*), the pressing roller 27A includes a core metal 30A formed in a pipe made of steel or aluminum, the elastic layer 29A formed of a silicone rubber, and a releasing layer 29Aa formed of a member coated with fluorine or a fluorine resin tube.

A modified example No. 2 of the fixing device 20 will be explained next. FIGS. 6(*a*) to 6(*d*) are schematic sectional views showing the modified example No. 2 as a fixing device 20B of the image forming apparatus 1 according to the first embodiment of the present invention. More specifically, FIG. 6(*a*) is a schematic sectional view showing the modified example No. 2 as the fixing device 20B, FIG. 6(*b*) is an enlarged view of a portion L5 in FIG. 6(*a*), FIG. 6(*c*) is an enlarged view of a portion L6 in FIG. 6(*a*), and FIG. 6(*d*) is an enlarged view of a portion L7 in FIG. 6(*a*)

As shown in FIG. 6(*a*), the fixing device 20B is an extended fixing belt/a heating roller type. More specifically, the fixing device 20B includes a heating roller 21B, a halogen heater (for example, a heater 23B) as a heating member, a fixing roller 38B, an elastic layer 31B constituting a part of the fixing roller 38B, a pressing member (for example, a pressing roller 27B), an elastic layer 29B constituting a part of the pressing roller 27B, and a fixing belt 32B. It is noted that the fixing roller 38B and the fixing belt 32B constitute the rotational member.

As described above, FIG. 6(*b*) is the enlarged view of the portion L5 in FIG. 6(*a*). As shown in FIG. 6(*b*), the fixing roller 38B includes a core metal 34B formed in a pipe made of steel or aluminum, and the elastic layer 31B formed of a silicone rubber.

As described above, FIG. 6(*c*) is the enlarged view of the portion L6 in FIG. 6(*a*). As shown in FIG. 6(*c*), the pressing roller 27B includes a core metal 30B formed in a pipe made of steel or aluminum, the elastic layer 29B formed of a silicone rubber, and a releasing layer 29Ba formed of a member coated with fluorine or a fluorine resin tube.

As described above, FIG. 6(*d*) is the enlarged view of the portion L7 in FIG. 6(*a*). As shown in FIG. 6(*d*), the fixing belt 32B includes a base member 32Ba formed of a polyimide resin or stainless steel, an elastic layer 32Bb formed of a silicone resin, and a releasing layer 32Bc formed of a member coated with fluorine or a fluorine resin tube.

A modified example No. 3 of the fixing device 20 will be explained next. FIGS. 7(*a*) to 7(*d*) are schematic sectional views showing the modified example No. 3 as a fixing device 20C of the image forming apparatus 1 according to the first embodiment of the present invention. More specifically, FIG. 7(*a*) is a schematic sectional view showing the modified example No. 3 as the fixing device 20C, FIG. 7(*b*) is an enlarged view of a portion L8 in FIG. 7(*a*), FIG. 7(*c*) is an enlarged view of a portion L9 in FIG. 7(*a*), and FIG. 7(*d*) is an enlarged view of a portion L10 in FIG. 7(*a*)

As shown in FIG. 7(*a*), the fixing device 20C is a fixing belt/a plate heater type. More specifically, the fixing device 20C includes a heating member (for example, a heater 23C), a supporting member 33 for supporting the heater 23C, a fixing roller 38C, an elastic layer 31C constituting a part of the fixing roller 38C, a pressing member (for example, a pressing roller 27C), an elastic layer 29C constituting a part of the pressing roller 27C, and a fixing belt 32C. It is noted that the fixing roller 38C and the fixing belt 32C constitute the rotational member.

As described above, FIG. 7(*b*) is the enlarged view of the portion L8 in FIG. 7(*a*). As shown in FIG. 7(*b*), the fixing roller 38C includes a core metal 34C formed in a pipe made of steel or aluminum, and the elastic layer 31C formed of a silicone rubber.

As described above, FIG. 7(*c*) is the enlarged view of the portion L9 in FIG. 7(*a*). As shown in FIG. 7(*c*), the pressing roller 27C includes a core metal 30C formed in a pipe made of steel or aluminum, the elastic layer 29C formed of a silicone rubber, and a releasing layer 29Ca formed of a member coated with fluorine or a fluorine resin tube.

As described above, FIG. 7(*d*) is the enlarged view of the portion L10 in FIG. 7(*a*). As shown in FIG. 7(*d*), the fixing belt 32C includes a base member 32Ca formed of a polyimide resin or stainless steel, an elastic layer 32Cb formed of a silicone resin, and a releasing layer 32 Cc formed of a member coated with fluorine or a fluorine resin tube.

A modified example No. 4 of the fixing device 20 will be explained next. FIGS. 8(*a*) to 8(*d*) are schematic sectional views showing the modified example No. 4 as a fixing device 20D of the image forming apparatus 1 according to the first embodiment of the present invention. More specifically, FIG. 8(*a*) is a schematic sectional view showing the modified example No. 4 as the fixing device 20D, FIG. 8(*b*) is an enlarged view of a portion L11 in FIG. 8(*a*), FIG. 8(*c*) is an enlarged view of a portion L12 in FIG. 8(*a*), and FIG. 8(*d*) is an enlarged view of a portion L13 in FIG. 8(*a*)

As shown in FIG. 8(*a*), the fixing device 20D is a pressing belt/a pressing member type. More specifically, the fixing device 20D includes a rotational member (for example, a heating roller 21D), a halogen heater (for example, a heater 23D) as a heating member, a pressing roller 27D, a pressing belt 36D and a fixing pressing member (for example, a pressing member pad 37D). The pressing member pad 37D includes a base member formed of steel or aluminum, an elastic layer formed of a silicone rubber, and a sliding layer. It is noted that the pressing roller 27D, the pressing belt 36D, and the pressing member pad 37D constitute the pressing member.

As described above, FIG. 8(*b*) is the enlarged view of the portion L11 in FIG. 8(*a*). As shown in FIG. 8(*b*), the heating roller 21D includes a core metal 34D formed in a pipe made of steel or aluminum, an intermediate elastic layer 31D formed of a silicone rubber, and a releasing layer 31Da formed of a member coated with fluorine or a fluorine resin tube.

As described above, FIG. 8(C) is the enlarged view of the portion L12 in FIG. 8(*a*). As shown in FIG. 8(*c*), the pressing roller 27D includes a core metal 30D formed in a pipe made of steel or aluminum, and an elastic layer 29D formed of a silicone rubber.

As described above, FIG. 8(*d*) is the enlarged view of the portion L13 in FIG. 8(*a*). As shown in FIG. 8(*d*), the pressing belt 36D includes a base member 36Da formed of a polyimide resin or stainless steel, and a releasing layer 36Dc formed of a member coated with fluorine or a fluorine resin tube.

As described above in the modified examples No. 1 to No. 4, the present invention is applicable to the two-roller type shown in FIGS. 5(*a*) to 5(*c*), the extended fixing belt/the heating roller type shown in FIGS. 6(*a*) to 6(*d*), the fixing belt/the plate heater type shown in FIGS. 7(*a*) to 7(*d*), and the pressing belt/the pressing member type shown in FIGS. 8(*a*) to 8(*d*).

An operation of the image forming apparatus 1 will be explained next. As shown in FIG. 2, the sheet supply rollers 2*a* and 2*b* and the separation member 3 separates and supplies the print medium P retained in the sheet supply cassette 1*a* one by one. Then, the transportation roller 4 and the register roller 5 transports the print medium P to the transportation belt 9. The charging unit (not shown) charges the surfaces of the photosensitive drums 7, and the exposure device 10 exposes the surfaces of the photosensitive drums 7, thereby forming the static latent images thereon. Then, the developing device (not shown) develops the static latent images, so that the toner images T are formed on the photosensitive drums 7.

In the next step, when the transportation belt 9 transports the print medium P to pass through between the photosensitive drums 7 and the transfer rollers 8, the toner images T in the colors of black, yellow, magenta, and cyan are sequentially transferred to the print medium P, thereby forming the color toner image T. After the toner images T are transferred, the photosensitive member cleaning unit (not shown) removes toner remaining on the photosensitive drums 7.

After the toner images T are transferred, the print medium P is transported to the fixing device 20, so that the fixing device 20 fixes the color toner image T to the print medium P, thereby forming a color image. After the color toner image T is fixed to the print medium P, the discharge roller 11 discharges the print medium P, and the discharge transportation roller 12 discharges the print medium P on the upper cover 13.

An operation of the fixing device 20 will be explained next with reference to FIGS. 1 and 4. When the image forming apparatus 1 starts the printing operation, the pressing roller 27 in the fixing device 20 starts rotating. More specifically, the gear 28 of the pressing roller 27 receives a drive force from a fixing device drive gear disposed in a main body of the image forming apparatus 1, so that the pressing roller 27 rotates in a direction to transport the print medium P. Accordingly, the fixing film 22 follows the rotation of the pressing roller 27 and rotates as well. A power supply circuit (not shown) supplies a current to the heater 23, so that the heater 23 heats the fixing film 22 from inside.

In the next step, a thermistor as the temperature detection unit 24 detects the temperature of the heater 23 thus heated, and the temperature is input into the temperature control unit 52. Accordingly, the temperature control unit 52 controls the current supplied from the power supply circuit to the heater 23 according to the temperature thus detected of the heater 23, so that the surface temperature of the fixing film 22 is maintained at an optimal fixing temperature.

In the next step, in the state that the surface temperature of the fixing film 22 is maintained at the optimal fixing temperature, the toner image T is heated. Further, the pressing roller 27 presses the toner image T with a specific force, so that the toner image T is fixed to the print medium P. After the toner image T is fixed to the print medium P, the print medium P is discharged outside the image forming apparatus 1, thereby completing the image forming operation.

FIG. 9 is a flow chart showing the operation of the image forming apparatus 1 according to the first embodiment of the present invention. In particular, the flow chart shown in FIG. 9 represents the operation of the image forming apparatus 1, in which the image forming apparatus 1 switches to a power save mode or a consumption power save mode from an idle state at a time when the image forming apparatus 1 completes the image forming operation in a normal mode until the image forming apparatus 1 starts a next image forming operation.

In step S1, after the fixing device 20 completes the fixing operation, the image forming apparatus control unit 40 having the power save control unit 41 instructs the temperature control unit 52 to turn off the heater 23, so that the temperature control unit 52 turns off the heater 23. In step S2, after the image forming apparatus control unit 40 discharges the print medium P outside the image forming apparatus 1, the image forming apparatus control unit 40 instructs the fixing control unit 50 to stop the drive motor 53, so that the drive control unit 51 stops the drive motor 53.

In step S3, the image forming apparatus control unit 40 controls the timer 43 to start measuring a termination time t. In step S4 and step S5, while the timer 43 is measuring the termination time t, the image forming apparatus control unit 40 monitors through the print data receiving unit 42 whether a start signal is input for instructing the image forming apparatus control unit 40 to start the image forming operation. More specifically, in step S4, the image forming apparatus control unit 40 monitors through the print data receiving unit 42 whether the start signal for starting the image forming operation is input until the termination time t reaches a predetermined specific time ts. In step S5, the image forming apparatus control unit 40 determines whether the termination time t reaches the predetermined specific time ts (a power save mode transition time ts).

When the image forming apparatus control unit 40 determines that the start signal for starting the image forming operation is input (step S4, Yes), the process proceeds to step S10, so that the image forming operation starts through the steps described above. When the image forming apparatus control unit 40 determines that the start signal for starting the image forming operation is not input (step S4, No), and the image forming apparatus control unit 40 determines that the termination time t reaches the power save mode transition time is (step S5, Yes), the power save control unit 41 selects the power save mode.

In step S6, the image forming apparatus control unit 40 instructs the fixing control unit 50 to start driving the drive motor 53, so that the fixing control unit 50 starts driving the drive motor 53. Accordingly, the drive force of the drive motor 53 is transmitted to the gear 28 of the pressing roller 27, so that the pressing roller 27 rotates, thereby rotating the fixing film 22.

In step S7 and Step S8, the image forming apparatus control unit 40 instructs the fixing control unit 50 to move the nip portion N by a predetermined nip portion movement amount N1, so that the drive control unit 51 drives the drive motor 53. More specifically, in step S7, the image forming apparatus control unit 40 determines whether the nip portion N moves by the predetermined nip portion movement amount N1. In step S8, when the image forming apparatus control unit 40 determines that the nip portion N moves by the predetermined nip portion movement amount N1 (step S7, Yes), the drive control unit 51 stops the drive motor 53. Accordingly, the pressing roller 27 and the fixing film 22 stop.

Through the steps described above, the image forming apparatus 1 completely switches to the power save mode. In step S9, the image forming apparatus control unit 40 instructs the print data receiving unit 42 to monitor whether the start signal for starting the image forming operation is input. When the image forming apparatus control unit 40 determines that the start signal for starting the image forming operation is input (step S9, Yes), the process proceeds to step S10, so that the image forming operation starts through the steps described above.

FIG. 10 is a time chart showing the operation of the image forming apparatus 1 according to the first embodiment of the present invention.

When the print data receiving unit 42 receives the image forming operation start signal at a timing t0, the heater 23 and the temperature control unit 52 are turned on, thereby increasing a temperature H of the heater 23. During this period of time, the temperature control unit 52 controls the heater 23 to turn on or off to maintain the predetermined temperature. Accordingly, a temperature Tf of the fixing film 22 and a temperature Tp of the pressing roller 27 increase. In this state, the print medium P passes through the fixing device 20, thereby performing the fixing operation.

When the fixing operation is complete at a timing t1, the image forming apparatus control unit 40 instructs the temperature control unit 52 to turn off the heater 23, so that the temperature control unit 52 turns off the heater 23. After the print medium P is discharged outside the image forming apparatus 1, the image forming apparatus control unit 40 instructs the fixing control unit 50 to stop the drive motor 53, so that the drive control unit 51 stops the drive motor 53, thereby proceeding to the idle state. In the idle state, the temperature control unit 52 controls the heater 23 to turn on for a specific period of time to maintain the predetermined temperature, so that the fixing device 20 is not cooled down.

In the next step, the image forming apparatus control unit 40 controls the timer 43 to measure the termination time t. Further, the image forming apparatus control unit 40 controls the print data receiving unit 42 to monitor whether the start signal for starting the image forming operation is input. When the image forming apparatus control unit 40 determines that the start signal for starting the image forming operation is not input, and the termination time t reaches the predetermined power mode switch time is at a timing t2, the image forming apparatus control unit 40 instructs the fixing control unit 50 to drive the drive motor 53. Accordingly, the nip portion N moves, and the image forming apparatus 1 becomes the power save mode.

In the power save mode, the control of the heater 23 is stopped. More specifically, the temperature detection unit 24 does not detect the temperature, or the temperature control unit 52 does not control. In other word, the fixing device 20 is not controlled to maintain the specific temperature, thereby reducing power consumption.

In the embodiment, it is configured such that the image forming apparatus 1 becomes the power save mode after 60 seconds after the image forming operation is complete, and the drive motor 53 is stopped. Further, the predetermined nip portion movement amount N1 is set to be greater than the width of the nip portion N and smaller than a difference between a circumferential length of one of the rotational members with a greater outer diameter forming the nip portion N and the width of the nip portion N. For example, the predetermined nip portion movement amount N1 is set to 10 mm. Further, the pressing roller 27 rotates at a speed equal to a printing speed.

As described above, in the embodiment, after the image forming operation is complete, when the image forming apparatus 1 switches to the power save mode the nip portion N moves in the state that the fixing film 22 and the pressing roller 27 are in the high temperature state. Accordingly, it is possible to prevent the fixing film 22 and the elastic layer 29 of the pressing roller 27 from generating creep.

More specifically, an image forming apparatus may be configured such that a fixing film rotates in an idle state to prevent an elastic layer from generating creep. In this case, when the image forming apparatus switches to the power save mode after 59 minutes after the image forming operation is complete and the image forming operation starts per every 60 minutes, a nip portion stays at a same position at a high temperature for a long period of time. When the image forming apparatus with the configuration described above is placed for a couple of days over a weekend, the elastic layer of a pressing roller tends to generate creep, thereby creating an image gloss variation in the next printing operation.

Further, when an image forming apparatus is configured such that a user can push a power save mode button to switch to the power save mode, the image forming apparatus switches to the power save mode at an arbitrary timing. Accordingly, similar to the case explained above, the image forming apparatus switches to the power save mode while a nip portion does not move in the idle state.

On the other hand, in the embodiment described above, when the image forming apparatus 1 is in the idle state, the nip portion N moves, and then the image forming apparatus 1 switches to the power save mode, thereby making it possible to prevent creep. Accordingly, it is possible to prevent the image gloss variation (the nip mark). Further, it is not necessary to move the pressing roller 27, thereby making it possible to simplify the configuration of the image forming apparatus 1.

Second Embodiment

A second embodiment of the present invention will be explained next. The image forming apparatus 1 in the second embodiment has a configuration similar to that in the first embodiment.

In the second embodiment, the image forming apparatus 1 is the heating film type. Similar to the first embodiment, the present invention is applicable to the two-roller type shown in FIGS. 5(*a*) to 5(*c*), the extended fixing belt/the heating roller type shown in FIGS. 6(*a*) to 6(*d*), the fixing belt/the plate heater type shown in FIGS. 7(*a*) to 7(*d*), and the pressing belt/the pressing member type shown in FIGS. 8(*a*) to 8(*d*).

FIG. 11 is a flow chart showing an operation of the image forming apparatus 1 according to the second embodiment of the present invention. In the flow chart shown in FIG. 11, steps similar to those in the flow chart shown in FIG. 9 are designated with the same numbers.

In the second embodiment, the operation of the image forming apparatus 1 is similar to that in the first embodiment, except the following steps. In particular, a temperature Th of the nip portion N is set in advance. After the image forming apparatus 1 starts switching to the power save mode, when the nip portion N reaches the temperature Th, the nip portion N starts moving. It is configured such that the temperature control unit 52 retrieves an output of the temperature detection unit 24, so that the image forming apparatus control unit 40 monitors the temperature of the nip portion N. When the temperature Tn of the nip portion N becomes the temperature T set in advance, the nip portion N starts moving.

The operation of the image forming apparatus 1 will be explained with reference to FIG. 11. The operation starts when the image forming apparatus 1 completes the printing operation. Similar to the first embodiment, the following steps are performed: in step S1, the heater 23 is turned off; in step S2, the drive motor 53 is turned off; in step S3, the measurement of the termination time t starts; in step S4, it is determined whether the image forming operation start signal is input; in step S5, it is determined whether the power save mode transition time is elapsed; in step S6, the drive motor 53 is driven; in step S7, it is determined whether the nip portion N moves by the nip portion movement amount N1; and in step S8, the drive motor 53 stops.

In the embodiment, after the image forming apparatus 1 switches to the power save mode, the temperature control unit 52 retrieves the output of the temperature detection unit 24, so that the image forming apparatus control unit 40 monitors the temperature of the nip portion N during the idle state.

In step S9, while the image forming apparatus control unit 40 monitors the temperature of the nip portion N, the image forming apparatus control unit 40 monitors through the print data receiving unit 42 whether the start signal for starting the image forming operation is input. When the image forming apparatus control unit 40 determines that the start signal for starting the image forming operation is input (step S9, Yes) until the temperature Tn of the nip portion N reaches the temperature Th set in advance, the process proceeds to step S10. Accordingly, the image forming operation starts through the steps described above.

When the image forming apparatus control unit 40 determines that the start signal for starting the image forming operation is not input (step S9, No), the process proceeds to step S21. In step S21, it is determined whether the temperature Tn of the nip portion N reaches the temperature Th set in advance. When it is determined that the temperature Tn of the nip portion N reaches the temperature Th set in advance (step S21, Yes), the process proceeds to step S22.

In step S22, the image forming apparatus control unit 40 instructs the fixing control unit 50 to drive the drive motor 53, so that the drive control unit 51 drives the drive motor 53. Accordingly, the drive force of the drive motor 53 is transmitted to the gear 28 of the pressing roller 27, so that the pressing roller 27 rotates, thereby rotating the fixing film 22. When the pressing roller 27 rotates, the fixing film 22 follows the rotation of the pressing roller 27 to rotate.

In step S23, the image forming apparatus control unit 40 determines whether the nip portion N moves by the nip portion movement amount N1. The nip portion movement amount N1 is determined similarly to that in the first embodiment. In step S24, after the nip portion N moves by the predetermined nip portion movement amount N1, the drive control unit 51 stops the drive motor 53. Accordingly, the pressing roller 27 and the fixing film 22 stop.

In step S25, the image forming apparatus control unit 40 monitors through the print data receiving unit 42 whether the start signal for starting the image forming operation is input. When the image forming apparatus control unit 40 determines that the start signal for starting the image forming operation is input (step S25, Yes), the process proceeds to step S10. Accordingly, the image forming operation starts through the steps described above.

FIG. 12 is a time chart showing the operation of the image forming apparatus 1 according to the second embodiment of the present invention. The time chart shown in FIG. 12 represents a period of time from when the image forming apparatus 1 completes the image forming operation to when the image forming apparatus 1 starts the next image forming operation.

During the period of time, the time chart shows state transition of the temperature Tn of the nip portion N between the fixing film 22 and the pressing roller 27, the on/off state of the heater 23, the passing state of the print medium P through the fixing device 20, and the on/off state of the drive motor 53. In particular, the time chart shows a relationship between the timing and the temperature when the idle state charges to the power save mode.

In the second embodiment, from the timing t0 to the timing t2, the image forming apparatus 1 performs the operation similar to that in the first embodiment. At a timing t2, when the image forming apparatus control unit 40 determines that the start signal for starting the image forming operation is not input, and the termination time t thus measured reaches the predetermined power mode switch time ts, the image forming apparatus control unit 40 instructs the fixing control unit 50 to drive the drive motor 53. Accordingly, the nip portion N moves, and the image forming apparatus 1 becomes the power save mode. In the power save mode, the control of the heater 23 is stopped.

After the timing t2, the temperature Tf of the fixing film 22 and the temperature Tp of the pressing roller 27 decrease. During the period, the temperature control unit 52 retrieves the output of the temperature detection unit 24, so that the temperature control unit 52 monitors the temperature Tn of the nip portion N. At a timing t3, when the temperature Tn of the nip portion N reaches the temperature Th set in advance, the image forming apparatus control unit 40 instructs the fixing control unit 50 to drive the drive motor 53, so that the nip portion N moves.

In the second embodiment, a period of time from when the drive motor 53 stops after the image forming operation to when the image forming apparatus 1 switches to the power save mode is set to 60 seconds. The nip portion movement amount N1 is set to 10 mm. Further, the pressing roller 27 is arranged to rotate at a speed equal to the printing speed. Still further, it is configured such that the nip portion N starts moving at the temperature of 40° C.

As described above, in the second embodiment, in addition to the effect in the first embodiment, it is configured such that the nip portion N moves once again when the temperature Tn of the nip portion N decreases below the specific temperature Th after the image forming apparatus 1 switches to the power save mode. Accordingly, it is possible to move the position of the nip portion N after the image forming apparatus 1 switches to the power save mode. As a result, it is possible to securely prevent the fixing film 22 and the elastic layer 29 of the pressing roller 27 from generating creep.

Third Embodiment

A third embodiment of the present invention will be explained next. The image forming apparatus 1 in the third embodiment has a configuration similar to that in the first embodiment.

In the third embodiment, similar to the first and second embodiments, the present invention is applicable to the two-roller type shown in FIGS. 5(*a*) to 5(*c*), the extended fixing belt/the heating roller type shown in FIGS. 6(*a*) to 6(*d*), the fixing belt/the plate heater type shown in FIGS. 7(*a*) to 7(*d*), and the pressing belt/the pressing member type shown in FIGS. 8(*a*) to 8(*d*).

FIG. 13 is a flow chart showing an operation of the image forming apparatus 1 according to the third embodiment of the present invention. In the flow chart shown in FIG. 13, steps similar to those in the flow chart shown in FIG. 11 are designated with the same numbers.

FIG. 14 is a time chart No. 1 showing the operation of the image forming apparatus 1 according to the third embodiment of the present invention. In the time chart shown in FIG. 14, steps similar to those in the time chart shown in FIG. 12 are designated with the same numbers.

FIG. 15 is a time chart No. 2 showing the operation of the image forming apparatus 1 according to the third embodiment of the present invention. In the time chart shown in FIG. 15, steps similar to those in the time chart shown in FIG. 12 are designated with the same numbers.

The flow chart shown in FIG. 13 represents the operation from when the image forming apparatus 1 starts switching to the power save mode as a first power save mode to a sleep mode as a second power save mode. In the sleep mode, the power consumption is reduced to an extent further than that in the power save mode.

The time chart shown in FIG. 14 represents a relationship between the timing and the temperature from when the image forming apparatus 1 starts switching to the power save mode to when the image forming apparatus 1 moves to the sleep mode. More specifically, the time chart shows that a sleep mode transition time tds is elapsed after the nip portion N starts moving when the nip temperature Tn becomes the temperature Th in the power save mode. Similarly, the time chart shown in FIG. 15 shows that the sleep mode transition time tds is elapsed before the nip portion N starts moving when the nip temperature Tn becomes the temperature Th in the power save mode.

The operation of the image forming apparatus 1 will be explained with reference to FIG. 13. The operation from when the nip portion N moves after the power save mode transition time is elapsed to when the drive motor 53 stops is similar to those in the first and second embodiment, and is not shown in FIG. 13.

Similar to the first and the second embodiments, the following steps are performed: in step S1, the heater 23 is turned off; in step S2, the drive motor 53 is turned off; in step S3, the measurement of the termination time t starts; in step S4, it is determined whether the image forming operation start signal is input; in step S5, it is determined whether the power save mode transition time is elapsed; in step S6, the drive motor 53 is driven; in step S7, it is determined whether the nip portion N moves by the nip portion movement amount N1; and in step S8, the drive motor 53 stops.

In step S31, the image forming apparatus control unit 40 starts measuring the termination time t at the timing t2 until the sleep mode transition time tds is elapsed. In step S9, while the timer 43 measures time, the image forming apparatus control unit 40 monitors through the print data receiving unit 42 whether the start signal for starting the image forming operation is input. In the third embodiment, after the image forming apparatus 1 starts switching to the power save mode, the temperature control unit 52 retrieves the output of the temperature detection unit 24, so that the image forming apparatus control unit 40 continues to monitor the temperature Tn of the nip portion N from the idle state. While the image forming apparatus control unit 40 monitors the temperature Tn of the nip portion N, the image forming apparatus control unit 40 monitors through the print data receiving unit 42 whether the start signal for starting the image forming operation is input.

In step S21, it is determined whether the temperature Tn of the nip portion N reaches the temperature Th set in advance. In step S32, it is determined whether the sleep mode transition time tds is elapsed. Accordingly, through step S21 and step S32, the image forming apparatus control unit 40 continues to monitor the temperature Tn of the nip portion N until the termination time t becomes the sleep mode transition time tds, and the temperature Tn of the nip portion N reaches the temperature Th set in advance.

In step S22, the image forming apparatus control unit 40 instructs the fixing control unit 50 to drive the drive motor 53, so that the drive control unit 51 drives the drive motor 53. In step S23, the image forming apparatus control unit 40 determines whether the nip portion N moves by the nip portion movement amount N1. In step S24, after the nip portion N moves by the predetermined nip portion movement amount N1, the drive control unit 51 stops the drive motor 53.

Accordingly, through step S22, step S23, and step S24, when the start signal for starting the image forming operation is not input, and the temperature Tn of the nip portion N becomes the temperature Th, the nip portion N moves at the timing t3 shown in FIG. 14 similarly to that in the second embodiment.

In step S25, the image forming apparatus control unit 40 monitors through the print data receiving unit 42 whether the start signal for starting the image forming operation is input. In step S33, it is determined whether the sleep mode transition time tds is elapsed. Accordingly, through step S25 and step S33, when the start signal for starting the image forming operation is not input, and the termination time t thus measured becomes the sleep mode transition time tds, the image forming apparatus control unit 40 instructs the fixing control unit 50 to drive the drive motor 53 at a timing t4 shown in FIG. 14.

In step S34, the image forming apparatus control unit 40 instructs the fixing control unit 50 to drive the drive motor 53, so that the drive control unit 51 drives the drive motor 53. In step S35, the image forming apparatus control unit 40 determines whether the nip portion N moves by the nip portion movement amount N1. In step S36, after the nip portion N moves by the predetermined nip portion movement amount N1, the drive control unit 51 stops the drive motor 53. Accordingly, through step S34, step S35, and step S36, the drive control unit 51 drives the drive motor 53 to move the nip portion N. Afterward, the image forming apparatus 1 becomes the sleep mode.

In step S37, the image forming apparatus control unit 40 monitors through the print data receiving unit 42 whether the start signal for starting the image forming operation is input. When the image forming apparatus control unit 40 determines that the start signal for starting the image forming operation is input, the process proceeds to step S10. Accordingly, the image forming operation is performed through the steps described above.

As described above, as shown in FIG. 14, the operation is performed when the sleep mode transition time tds is elapsed after the nip portion N starts moving when the nip temperature Tn becomes the temperature Th in the power save mode.

The time chart shown in FIG. 15 shows that the sleep mode transition time tds is elapsed before the nip portion N starts moving when the nip temperature Tn becomes the temperature Th in the power save mode.

In this case, as shown in FIG. 13, the process proceeds from step S32 to step S34, so that the nip portion N moves by the nip portion movement amount N1, thereby proceeding to the sleep mode at the timing t3 shown in FIG. 15. Afterward, in step S37, the image forming apparatus control unit 40 monitors through the print data receiving unit 42 whether the start signal for starting the image forming operation is input.

In the third embodiment, a period of time from when the drive motor 53 stops after the image forming operation to when the image forming apparatus 1 switches to the sleep mode is set to 30 minutes. The nip portion movement amount N1 is set to 10 mm. Further, it is configured such that the nip portion N starts moving at the temperature of 40° C.

When the temperature Tn of the nip portion N becomes very low in the sleep mode, a sliding surface between the fixing film 22 and the pressing roller 27 has a large frictional coefficient, thereby requiring the drive force greater than that in the normal mode. In an extreme case, the fixing film 22 does not move. Accordingly, it is preferred to rotate the pressing roller 27 at a low speed. In the third embodiment, it is configured such that the pressing roller 27 rotates at a speed of 48 mm/sec. (corresponding to 8 ppm), a lowest speed within a speed variation during the image forming operation.

As described above, in the third embodiment, in addition to the effects in the first and second embodiments, even when the temperature Tn of the nip portion N becomes very low in the sleep mode, it is possible to securely drive the nip portion N when the image forming apparatus 1 switches to the sleep mode. Accordingly, it is possible to prevent the nip portion N from staying at a same location for a long period of time, thereby reducing creep.

The present invention is not limited to the embodiments described above, and may be applicable for various configurations and modifications. For example, in the embodiments, the printer is explained as the image forming apparatus 1, and the present invention is applicable to an image forming apparatus such as a facsimile, a copier, and a multi function peripheral or product (MFP).

Further, in addition to a normal paper sheet, the print medium P may include a special sheet such as an OHP sheet, a card, a postcard, a cardboard having a weight greater than 200 g/m$^2$, an envelope, a coat sheet with large heat capacity, and the like.

Further, the fixing device 20 may be integrally attached to the image forming apparatus 1, or detachably attached to the image forming apparatus 1. Other than the operations in the first to third embodiment, it may be configured such that the image forming apparatus 1 switches to the power save mode through an instruction from the PC 61 or an instruction through an operation panel of the image forming apparatus 1. In this case, it is configured such that the nip portion N moves when the image forming apparatus 1 switches to the power save mode.

The disclosure of Japanese Patent Application No. 2009-280202, filed on Dec. 10, 2009, is incorporated in the application.

While the invention has been explained with reference to the specific embodiments of the invention, the explanation is illustrative and the invention is limited only by the appended claims.

What is claimed is:

1. An image forming apparatus comprising:

a fixing device including a rotational member, a pressing member disposed to press against the rotational member for sandwiching and pressing a print medium with the rotational member after a developer image is developed on the print medium, and a heating portion for heating the rotational member;

a mode selecting unit for selecting one of a normal mode, in which a printing operation is enabled, and a power save mode, in which the printing operation is partially terminated to conserve power consumption; and a fixing control unit for controlling the rotational member to rotate for a specific amount when the mode selecting unit selects the power save mode, wherein said fixing control unit is arranged to control the rotational member to rotate for the specific amount greater than a width of a contact portion between the rotational member and the pressing member and smaller than a difference between a circumferential length of the rotational member and the width of the contact portion.

2. The image forming apparatus according to claim 1, wherein said fixing control unit is arranged to control the rotational member to rotate when the image forming apparatus switches to the power save mode.

3. The image forming apparatus according to claim 1, wherein said fixing control unit is arranged to control the rotational member to rotate when a temperature of the rotational member or the pressing member becomes less than a specific level after the image forming apparatus switches to the power save mode.

4. The image forming apparatus according to claim 1, wherein said mode selecting unit is arranged to select the power save mode including a first power save mode, in which the printing operation is partially terminated to conserve the power consumption by a specific power amount, and a second power save mode, in which the power consumption is conserved further than that in the first power save mode, said fixing control unit being arranged to control the rotational member to rotate for the specific amount when the mode selecting unit switches from the first power save mode to the second power save mode.

5. The image forming apparatus according to claim 4, wherein said fixing control unit is arranged to control the rotational member to rotate for the specific amount at a first rotational speed when the mode selecting unit selects the power save mode, and said fixing control unit is arranged to control the rotational member to rotate for the specific amount at a second rotational speed different from the first rotational speed when the mode selecting unit switches from the first power save mode to the second power save mode.

6. The image forming apparatus according to claim 1, wherein said heating portion includes a ceramic heater, said rotational member includes a film member, and said pressing member includes a pressing roller.

7. The image forming apparatus according to claim 1, wherein said rotational member includes a fixing roller and a fixing belt, and said pressing member includes a pressing roller.

8. The image forming apparatus according to claim 1, wherein said rotational member includes a fixing roller, and said pressing member includes a pressing roller, a pressing belt, and a fixing pressing member.

9. The image forming apparatus according to claim 1, wherein said mode selecting unit is arranged to select the one of the normal mode and the power save mode when a predetermined period of time is elapsed.

10. The image forming apparatus according to claim 9, wherein said mode selecting unit is arranged to select the one of the normal mode and the power save mode immediately after a user selects the one of the normal mode and the power save mode.

11. An image forming apparatus comprising:

a fixing device including a rotational member, a pressing member disposed to press against the rotational member for sandwiching and pressing a print medium with the rotational member after a developer image is developed on the print medium, and a heating portion for heating the rotational member;

a mode selecting unit for switching a mode of the image forming apparatus from a first mode to a second mode; and a fixing control unit for controlling the rotational member to rotate for a specific amount if a transition condition is met for the mode selecting unit to switch the first mode to the second mode, wherein said fixing control unit is arranged to control the rotational member to rotate for the specific amount greater than a width of a contact portion between the rotational member and the pressing member and smaller than a difference between a circumferential length of the rotational member and the width of the contact portion.

12. The image forming apparatus according to claim 11, wherein said mode selecting unit is arranged to switch the mode of the image forming apparatus from the second mode to a third mode, said fixing control unit is arranged to control the rotational member to rotate for the specific amount at a first rotational speed if the transition condition is met for the mode selecting unit to switch the first mode to the second mode, and said fixing control unit is arranged to control the rotational member to rotate for the specific amount at a second rotational speed different from the first rotational speed if a transition condition is met for the mode selecting unit to switch the second mode to the third mode.

13. The image forming apparatus according to claim 12, wherein said mode selecting unit is arranged to switch the mode of the image forming apparatus from the first mode, in which a normal printing operation is performed, to the second mode, in which a power save printing operation is performed to lower power consumption than the normal printing operation, and said fixing control unit is arranged to control the rotational member to rotate for the specific amount at the second rotational speed lower than the first rotational speed if the transition condition is met for the mode selecting unit to switch the second mode to the third mode.

14. The image forming apparatus according to claim 13, wherein said fixing control unit is arranged to control the rotational member to rotate for the specific amount at the second rotational speed lower than the first rotational speed when the mode selecting unit switches from the first power save mode to the second power save mode.

15. The image forming apparatus according to claim 11, wherein said fixing control unit is arranged to control the rotational member to rotate for the specific amount if a specific condition is satisfied after the fixing control unit controls the rotational member to rotate for the specific amount if the transition condition is met for the mode selecting unit to switch the second mode to the third mode.

16. The image forming apparatus according to claim 15, wherein said fixing control unit is arranged to control the rotational member to rotate for the specific amount if the specific condition, under which a temperature of the rotational member or the pressing member becomes lower than a specific temperature, is satisfied.

* * * * *